US008837981B2

(12) United States Patent
Igarashi et al.

(10) Patent No.: US 8,837,981 B2
(45) Date of Patent: Sep. 16, 2014

(54) IMAGE FORMING APPARATUS AND IMAGE FORMING UNIT

(71) Applicants: Hiroshi Igarashi, Nagoya (JP); Naoya Kamimura, Ichinomiya (JP); Yoshiya Tomatsu, Kasugai (JP)

(72) Inventors: Hiroshi Igarashi, Nagoya (JP); Naoya Kamimura, Ichinomiya (JP); Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/079,878

(22) Filed: Nov. 14, 2013

(65) Prior Publication Data

US 2014/0072337 A1 Mar. 13, 2014

Related U.S. Application Data

(60) Continuation of application No. 13/686,473, filed on Nov. 27, 2012, now Pat. No. 8,606,145, which is a continuation of application No. 12/419,624, filed on Apr. 7, 2009, now Pat. No. 8,340,549, which is a division of application No. 11/235,310, filed on Sep. 27, 2005, now Pat. No. 7,778,567.

(30) Foreign Application Priority Data

Sep. 29, 2004 (JP) ..... 2004-285191
Sep. 29, 2004 (JP) ..... 2004-285218

(51) Int. Cl.
*G03G 15/00* (2006.01)
*G03G 21/18* (2006.01)
*G03G 15/01* (2006.01)

(52) U.S. Cl.
CPC .... *G03G 21/1842* (2013.01); *G03G 2221/1846* (2013.01); *G03G 15/0178* (2013.01); *G03G 21/1821* (2013.01); *G03G 2215/0119* (2013.01); *G03G 21/18* (2013.01)
USPC ..... 399/110

(58) Field of Classification Search
CPC ..... G03G 21/1846; G03G 2221/1846
USPC ..... 399/110, 111
See application file for complete search history.

(56) References Cited

U.S. PATENT DOCUMENTS 4,378,154 A 3/1983 Hoffman
4,708,455 A 11/1987 Kubota et al.

(Continued)

FOREIGN PATENT DOCUMENTS

CN 1445620 A 10/2003
EP 614130 A2 9/1994

(Continued)

OTHER PUBLICATIONS

EP Search Report dtd Jun. 7, 2006, EP Appln. 05021170.

(Continued)

*Primary Examiner* — Sandra Brase
(74) *Attorney, Agent, or Firm* — Banner & Witcoff, Ltd.

(57) ABSTRACT

Image forming apparatuses include: a casing; an image forming unit removable from the casing in a first direction; and plural developer cartridges. The cartridges may be attached and detached with respect to the image forming unit in a second direction that is inclined toward the first direction. Other image forming apparatuses include: a casing; an exposure device; a plurality of cartridges configured to be attached and detached with respect to the casing in a first direction; and a recording medium transport system for transporting recording media adjacent the photosensitive members in a second direction. The first direction may be inclined with respect to the second direction, and at least a portion of optical paths of the light emitted from the exposure device may extend parallel with the first direction. Aspects also relate to image forming units, e.g., for use in image forming apparatuses as described above.

16 Claims, 23 Drawing Sheets

(56) References Cited

U.S. PATENT DOCUMENTS

| | | | | |
|---|---|---|---|---|
| 4,926,219 | A | | 5/1990 | Hirasawa et al. |
| 5,303,018 | A | | 4/1994 | Terada et al. |
| 5,444,515 | A | | 8/1995 | Haneda et al. |
| 5,819,139 | A | * | 10/1998 | Harlan et al. ..... 399/110 |
| 5,978,626 | A | | 11/1999 | Nagamine et al. |
| 6,061,537 | A | | 5/2000 | Nakajima et al. |
| 6,101,349 | A | | 8/2000 | Ohashi et al. |
| 6,219,508 | B1 | | 4/2001 | Nagatomi et al. |
| 6,226,476 | B1 | | 5/2001 | Miyabe et al. |
| 6,411,789 | B1 | | 6/2002 | Okabe et al. |
| 6,647,227 | B2 | | 11/2003 | Yokoi et al. |
| 6,708,011 | B2 | | 3/2004 | Nomura et al. |
| 6,738,590 | B2 | | 5/2004 | Okimura et al. |
| 6,944,415 | B2 | | 9/2005 | Nomura |
| 7,072,602 | B2 | | 7/2006 | Hatori et al. |
| 7,862,030 | B2 | | 1/2011 | Igarashi |
| 2003/0053819 | A1 | | 3/2003 | Nomura et al. |
| 2004/0022556 | A1 | | 2/2004 | Nomura |
| 2004/0175203 | A1 | | 9/2004 | Kamimura |
| 2005/0047821 | A1 | | 3/2005 | Murayama et al. |
| 2005/0220480 | A1 | | 10/2005 | Miyabe et al. |

FOREIGN PATENT DOCUMENTS

| | | | |
|---|---|---|---|
| EP | 1273980 | A2 | 1/2003 |
| EP | 1331524 | A2 | 7/2003 |
| EP | 1331525 | A2 | 7/2003 |
| JP | 3-175459 | A | 7/1991 |
| JP | 05-257340 | A | 10/1993 |
| JP | 6-003919 | A | 1/1994 |
| JP | 10-339982 | A | 12/1998 |
| JP | 11-231594 | A | 8/1999 |
| JP | 2000-132028 | A | 5/2000 |
| JP | 2002-318478 | A | 10/2002 |
| JP | 2003-015378 | A | 1/2003 |
| JP | 2003-280313 | A | 10/2003 |
| JP | 2003-280491 | A | 10/2003 |
| JP | 2004-109886 | A | 4/2004 |
| JP | 2004-205594 | A | 7/2004 |

OTHER PUBLICATIONS

JP Office Action dtd Jul. 7, 2009, JP Appln. 2008-069528.

CN Office Action dated Jul. 29, 2010, Chinese Appln. 200510108739.5.

CN Office Action dated Dec. 27, 2010, Chinese Appln. 200510108739.5.

CN Office Action dated Apr. 7, 2011, Chinese Appln. 200510108739.5.

CN Office Action dated Mar. 14, 2012, Chinese Appln. 200510108739.5.

CN Notification of Re-examination Decision dated May 31, 2012, CN Appln. 200510108739.5.

* cited by examiner

IMAGE FORMING APPARATUS AND IMAGE FORMING UNIT

CROSS REFERENCE TO RELATED APPLICATIONS

This application is a continuation of prior U.S. application Ser. No. 13/686,473, filed Nov. 27, 2012, which is a continuation of prior U.S. application Ser. No. 12/419,624, filed Apr. 7, 2009, which issued Dec. 25, 2012 as U.S. Pat. No. 8,340,549, which is a divisional application of prior U.S. application Ser. No. 11/235,310, filed Sep. 27, 2005, which issued Aug. 17, 2010 as U.S. Pat. No. 7,778,567, which claims priority from Japanese Patent Application Nos. 2004-285191 and 2004-285218, both filed on Sep. 29, 2004. These priority applications are incorporated herein in their entirety by reference.

TECHNICAL FIELD

This invention generally relates to image forming apparatuses and image forming units used in such apparatuses.

BACKGROUND

Tandem-type image forming apparatuses using electrophotography are known. Image forming apparatuses of this type include photosensitive members corresponding to the toner colors of yellow, magenta, cyan, and black. Image formation process parts, such as developing cartridges and charging devices, typically are provided around the respective photosensitive members for the various colors. Image formation is implemented by transferring a toner image formed on each photosensitive member by toner of each color onto a sheet. In such image forming apparatuses, an openable cover often will be provided at a top of a main casing of the image forming apparatus. By opening the cover, various parts, such as the developing cartridges, disposed inside the image forming apparatus can be replaced with new ones, or a paper jam occurring within the main casing can be cleared. In other image forming apparatus structures, a drawer may be provided in which the developing cartridges are loaded. By pulling the drawer to a predetermined position from the main casing, replacement of the developing cartridges can be performed.

SUMMARY

Aspects of the invention relate to image forming apparatuses (such as printers (e.g., laser printers, color printers, etc.), copying machines, facsimile machines, scanners, multifunctional devices, and the like) and various components thereof (such as image forming units). Image forming apparatuses according to at least some examples of this invention may include: (a) a casing; (b) an image forming unit configured to be removed from the casing in a first direction (optionally completely detachable from the casing), wherein the image forming unit includes a frame; and (c) a plurality of cartridges, each of which includes at least one developing device for a respective photosensitive member. The cartridges may be configured to be attached and detached with respect to the frame of the image forming unit in a second direction, and this second direction may be inclined toward the first direction. Other image forming apparatuses according to at least some aspects of the invention may include: (a) a casing; (b) an exposure device that emits light; (c) a plurality of cartridges, each of which includes at least one developing device for a respective photosensitive member and each of which may be configured to be attached and detached with respect to the casing in a first direction; and (d) a recording medium transport system for transporting a recording medium adjacent the photosensitive members in a second direction. The first direction may be inclined with respect to the second direction, and at least a portion of optical paths of the light emitted from the exposure device to the photosensitive members may extend substantially in parallel with the first direction (the term "substantially in parallel," as used herein in this context, includes parallel).

Image forming units according to at least some example aspects of the invention may include: (a) a frame; (b) a plurality of cartridges, wherein each cartridge includes at least one developing device and is configured to be attachable to and detachable from the frame in a first direction; and (c) a plurality of photosensitive members, one photosensitive member corresponding to each of the respective plurality of cartridges. The photosensitive members may define an image transfer plane or direction (e.g., a general plane or direction on which recording media travels during the process of transferring the image to the recording media), wherein the first direction is inclined with respect to the image transfer plane or direction.

BRIEF DESCRIPTION OF THE DRAWINGS

Illustrative example structures according to the present invention will be described in more detail with reference to the following figures wherein.

DETAILED DESCRIPTION

Figure 1:
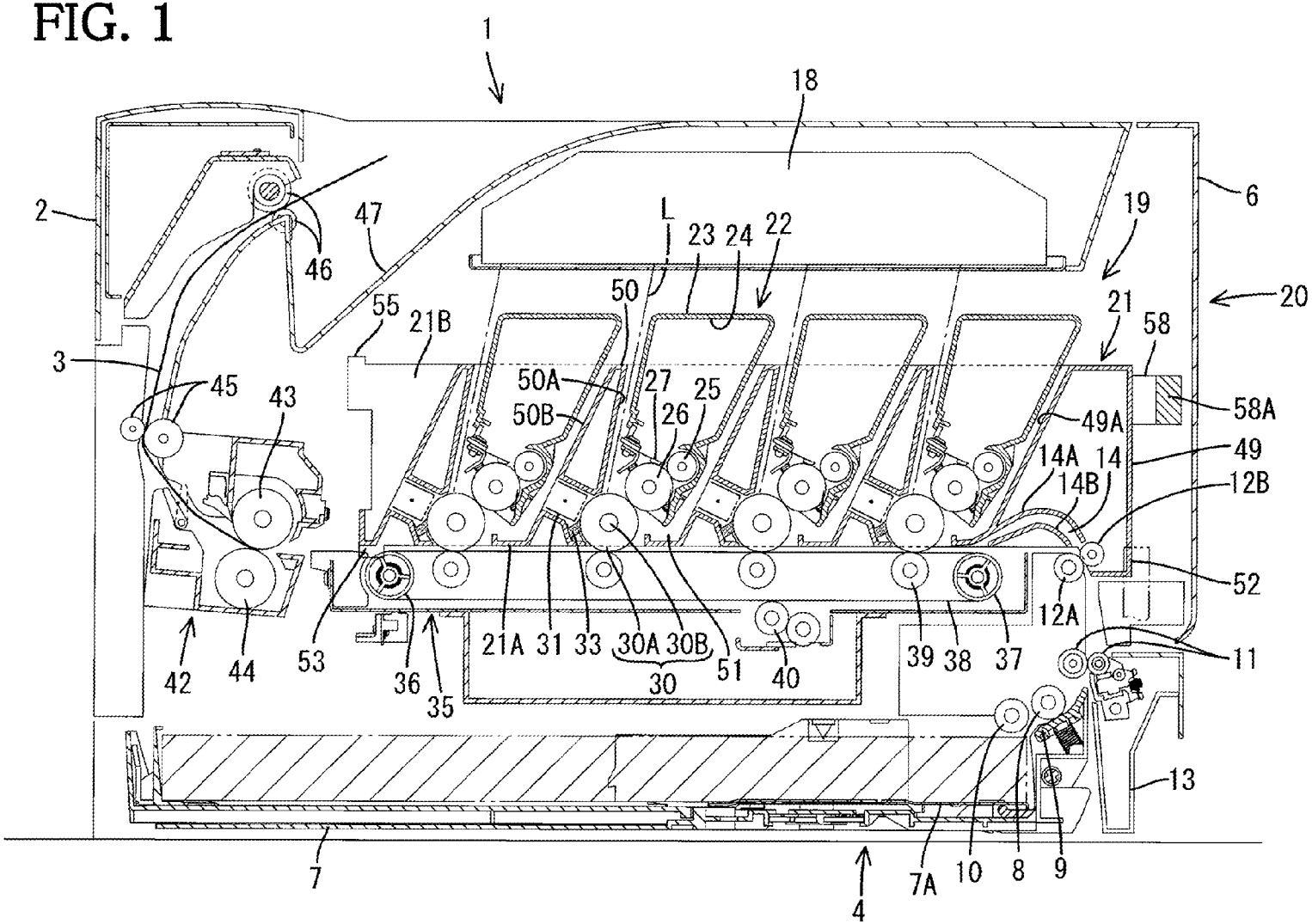
FIG. 1 is a sectional side view showing a schematic structure of a laser printer as an image forming apparatus according to a first example of the invention.

Various illustrative examples of the invention will be described with reference to the accompanying drawings. In the description that follows, various connections are set forth between elements in the overall structure. The reader should understand that these connections in general and, unless specified otherwise, may be direct or indirect and that this specification is not intended to be limiting in this respect.

I. General Description of Structures According to at Least Some Examples of the Invention Aspects of this invention relate to image forming apparatuses (such as printers (e.g., laser printers, color printers, etc.), copying machines, facsimile machines, scanners, multifunctional devices, and the like) and various components thereof. Image forming apparatuses according to at least some examples of this invention may include: (a) a casing; (b) an image forming unit configured to be removed from the casing in a first direction (optionally completely detachable from the casing), wherein the image forming unit includes a frame; and (c) a plurality of cartridges, each of which includes at least one developing device for a respective photosensitive member. The cartridges may be configured to be attached and detached with respect to the frame of the image forming unit in a second direction, and this second direction may be inclined, e.g., upward from and toward the first direction. The term "inclined," as used herein, unless otherwise noted, means in a direction other than parallel to or perpendicular to another direction. In at least some examples of this invention, the angle of incline will be in the range of 45° to 90° from the first direction, and even 65° to 90° from the first direction.

Example image forming apparatuses according to at least some aspects of the invention may include: (a) a casing; (b) an exposure device that emits light; (c) a plurality of cartridges, each of which includes at least one developing device for a respective photosensitive member and each of which may be configured to be attached and detached with respect to the casing in a first direction; and (d) a recording medium transport system for transporting a recording medium adjacent the photosensitive members in a second direction. In such example structures, if desired, the first direction may be inclined with respect to the second direction, and at least a portion of optical paths of the light emitted from the exposure device to the photosensitive members may extend substantially in parallel with the first direction. If desired, the first direction may be oriented at an angle in the range of 45° to 90° with respect to the second direction or even 65° to 90° with respect to the second direction. Additionally, if desired, one or more of the plurality of cartridges may be included in an image forming unit, and this image forming unit may be configured to be removed from the casing of the image forming apparatus in various directions, including in a direction substantially parallel to the second direction and/or in a direction substantially perpendicular to the second direction (the term "substantially parallel," as used in this context, includes parallel, and the term "substantially perpendicular," as used in this context, includes perpendicular).

Still further example aspects of this invention relate to component parts for use in image forming apparatuses, such as the image forming apparatuses described above. More specifically, at least some aspects of this invention relate to image forming units that may be included as part of image forming devices, such as printers (e.g., laser printers, color printers, etc.), copying machines, facsimile machines, scanners, multifunctional devices, and the like. Image forming units according to at least some examples of this invention may include: (a) a frame; (b) a plurality of cartridges, wherein each cartridge includes at least one developing device and is configured to be attachable to and detachable from the frame in a first direction; and (c) a plurality of photosensitive members, one photosensitive member corresponding to each of the respective plurality of cartridges. The photosensitive members may be engaged with the cartridges (such that they are removed along with the cartridges when the cartridges are removed from the frame), with the frame (such that they remain with the frame when the cartridges are removed from the frame), and/or with another portion of the overall image forming apparatus structure without departing from this invention. The plurality of photosensitive members may define an image transfer plane or direction (e.g., a general plane or direction on which recording media travels during the process of transferring the image to the recording media), wherein the first direction is inclined with respect to the image transfer plane or direction. If desired, in at least some structures, the frame of the image forming unit may define at least one groove extending in substantially the cartridge attachment and/or removal direction, wherein the cartridge(s) are engaged with the frame via the respective groove(s). In at least some example structures, the first direction may be inclined with respect to the image transfer plane or direction at an angle between 45° to 90°, or even at an angle between 65° to 90°.

Image forming units and image forming apparatuses according to at least some examples of this invention may have various additional features and/or characteristics. Examples of these potential features and characteristics are described in more detail below. Of course, these features and characteristics, when present in an image forming unit and/or an image forming apparatus, may be included in these individual units or apparatuses in various ways, through various different structures, and/or in various different combinations without departing from the invention. Moreover, an individual image forming unit or image forming apparatus need not have all or even any of these specific features or characteristics, but it still may fall within the scope of the present invention.

Image forming units according to at least some examples of this invention may be equipped with a grip portion. As one more specific example, the grip portion may be provided at a first end of the image forming unit, and the image forming unit may be configured to be separated or detached from the casing, at least in part, by lifting the grip portion upward. The grip portion additionally may be used, for example, to pull the image forming unit out of the casing of its image forming apparatus.

Image forming apparatuses according to at least some examples of this invention further may include an exposure device that emits light (e.g., laser light) and transmits the light to the photosensitive member (e.g., to thereby form an electrostatic latent image on the photosensitive member). If desired, in accordance with at least some examples of this invention, at least a portion of one or more optical paths of the light emitted from the exposure device to the photosensitive members may extend in a direction substantially in parallel with a direction in which the developing devices are attached to and detached from the image forming unit (the term "substantially in parallel," as used in this context, includes parallel).

Image forming apparatuses according to at least some additional examples of this invention also may include a transfer belt that transfers or transports recording media within the image forming apparatus (e.g., past the photosensitive members, etc.). If desired, the image forming unit may be configured to move with respect to the transfer belt when the image forming unit is moved into and out of the casing.

Additional features present in image forming apparatuses according to at least some examples of this invention include a supply tray for holding recording media and/or a discharge tray disposed to receive recording media once image formation is completed (e.g., and the recording medium is discharged from the casing). The supply tray, when present, may be removably mounted in the casing, and if desired, it may be removable from the casing in a direction substantially in parallel with the direction in which the image forming unit is pulled out of the casing (again, the term "substantially in parallel," as used in this context, includes parallel).

Image forming apparatuses and/or image forming units according to at least some examples of this invention further may include a "fall preventing device." The fall preventing device may function so as to allow the image forming unit to be moved to a stop position (e.g., extended from the casing to a position where one or more of the developing cartridges can be attached to and/or detached from the image forming unit, and when at this stop position, the fall preventing device prevents the image forming unit from falling from the casing. The fall preventing device further may be configured so as to selectively allow release of the image forming unit from the casing (e.g., to enable complete removal of the image forming unit).

As noted above, image forming units according to at least some examples of this invention further may include a grip portion. Grip portions, when present, can perform additional functions if desired, for example, in image forming apparatuses and/or image forming units that include fall preventing devices. For example, if desired, the grip portion may be configured to function as a mechanism for releasing the image forming unit from the fall preventing device (e.g., to enable complete removal of the image forming unit from the apparatus). As a more specific example, in some structures, the grip portion may include a first grip member provided on a first side of the image forming unit frame and a second grip member provided on a second side of the frame (e.g., on opposite sides of a central axis extending along the image forming unit removal direction), and this grip may be moved so as to release the fall prevention device. As another more specific example, if desired, the grip portion may be movable between a pulling position where the grip portion is located at an end of the image forming unit and a lifting position where the grip portion is located at a position in the unit pulling direction more close to a center of gravity of the frame than when the grip is in the pulling position. This change in grip position may result in release of the fall prevention device. As yet another more specific example, in at least some example structures according to the invention, the grip member may be included on a rotatable handle member, and a stopper may be provided to contact the handle member and restrict its rotation at a predetermined limit position (e.g., when the image forming unit is lifted with the handle member, a torque is generated in a direction to press the stopper against the handle member regardless of a condition of the plurality of cartridges (e.g., regardless of the number of cartridges in the image forming unit, regardless of their fill level, etc.)). Rotation of this grip member also may be used to release the fall prevention device.

Image forming apparatuses according to still further examples of this invention may include at least one cover member included with the casing, e.g., for covering an opening in the casing through which the image forming unit is moved into or out of the casing. In at least some examples, the cover member may be opened by tilting its upper end downward, e.g., toward the general direction in which the image forming unit will be pulled out of the casing. If desired, in structures where the image forming unit includes a grip portion, the grip portion may extend or protrude beyond the end of the cover member when the cover member is in the opened position and the image forming unit is removed from the casing (e.g., at the "stop" position described above).

Image forming units according to at least some examples of this invention further may include an "interference preventing device." The interference preventing device may be used to prevent the plurality of photosensitive members contained in the image forming unit from contacting a surface when the image forming unit is placed on the surface. In at least some example structures, the interference preventing device may define a resting plane for the image forming unit, wherein the plurality of photosensitive members are located at least a minimum distance from the resting plane and within the frame. As a more specific example, the interference preventing device may include one or more "foot portions" that protrude from the frame of the image forming unit, e.g., beyond a position or level of the photosensitive members. The interference preventing device may be used to prevent inadvertent contact between the photosensitive drum(s) and other elements or surfaces, e.g., to prevent damage to or contamination of the drums, to avoid contaminating external surfaces with developer, etc.

Given this general description, more detailed examples of structures according to the invention will be described below in conjunction with FIGS. 1-23. The reader should recognize that the specific illustrations and description below merely constitute examples of the invention and do not limit the invention.

II. Detailed Description of Specific Example Structures According to the Invention Referring to FIGS. 1 to 4C, an image forming apparatus in accordance with at least some examples of the invention will be described. While the illustrated examples of image forming apparatuses according to the invention show printer structures (e.g., laser printers, color printers, etc.), those skilled in the art will appreciate that aspects of the invention also may be used in conjunction with other image forming devices, such as copying machines, facsimile machines, scanners, multifunctional devices, and the like. As shown in FIG. 1, this example laser printer 1 is a so-called "direct-tandem-type color laser printer" that includes four photosensitive drums 30 corresponding to four colors, namely black, cyan, magenta, and yellow, and in which a toner image formed on each of the photosensitive drums 30 is directly transferred onto a recording medium. This example laser printer structure 1 includes, in a main casing 2, a sheet feeding part 4 that supplies sheets 3 as recording media, an image forming unit 20 that forms an image on a sheet 3 supplied therein, and a sheet conveying part 35 that conveys sheets 3 with respect to the image forming unit 20. In the following description, the right side in FIG. 1 will be referred to as the front side of the laser printer 1, the left side in FIG. 1 will be referred to as the back or rear of the laser printer 1, and the far side and the near side in FIG. 1 will be referred to as the right and the left of the laser printer 1, respectively.

Figure 2:
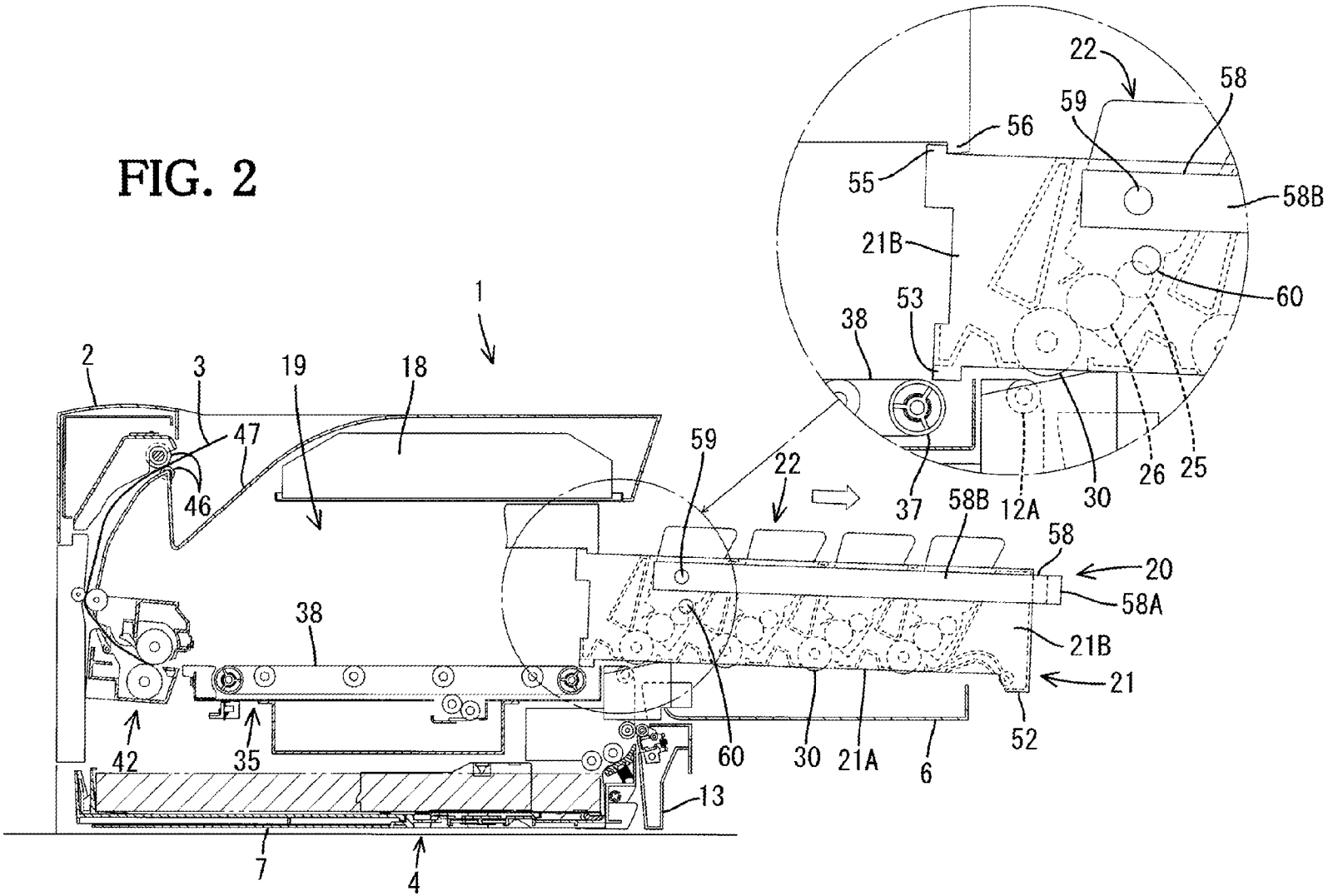
FIG. 2 is a sectional side view of the example laser printer of FIG. 1 in which an image forming unit is shown pulled out from a main casing of the laser printer.

The front of the main casing 2 in this example printer structure 1 is provided with a front cover 6, which is capable of opening and closing with respect to the main casing 2. This example front cover 6 is capable of pivoting between a covering position (FIG. 1) and an uncovering position (FIG. 2) about its lower end (e.g., about one or more shafts, hinges, or other structure). At the covering position, as shown in FIG. 1, the front cover 6 extends in a substantially upright position to cover the front of the main casing 2. At the uncovering position, as shown in FIG. 2, the front cover 6 extends to a substantially horizontal position ("substantially horizontal," as used in this context, includes horizontal). By pivoting the front cover 6 toward the front and away from the main casing 2 and away from the covering position, the front cover 6 is moved to the uncovering position. When the front cover 6 is located at the uncovering position, the image forming unit 20 can be installed into and/or removed from (e.g., pulled toward the front of) the main casing 2. When the front cover 6 is located at the covering position in this example structure, a surface of an upper end of the front cover 6 extends substantially in the same plane as a top surface of the main casing 2 ("substantially in the same plane," as used in this context, includes in the same plane).

The sheet feeding part 4 of this example structure 1 includes, at a bottom portion in the main casing 2, a sheet supply tray 7, a sheet supply roller 8, a separating pad 9, a pickup roller 10, a pair of paper dust removing rollers 11, and a pair of register rollers 12A and 12B. The sheet supply tray 7 is attachable to and detachable from the bottom portion of the main casing 2. The sheet supply roller 8 and the separating pad 9 are provided at an upper portion of a front end portion of the sheet supply tray 7. The pickup roller 10 is provided at the rear of the sheet supply roller 8. The paper dust removing rollers 11 are disposed at an upper front side of the sheet supply roller 8. The register rollers 12A and 12B are disposed above the pair of paper dust removing rollers 11.

The sheet supply tray 7 in this example structure 1 has a thin plate shape and can contain sheets 3 in layers therein. The sheet supply tray 7 includes a front wall 13 at its front end. The front wall 13 is located under the front cover 6 when the sheet supply tray 7 is attached to the main casing 2. By pulling a handle formed by the front wall 13 of the sheet supply tray 7 in a direction toward the front of the printer 1, the sheet supply tray 7 can be horizontally drawn from the front of the main casing 2. Inside the sheet supply tray 7 of this example structure, at its bottom, a sheet pressing plate 7A is provided. The sheet supply tray 7 and pressing plate 7A are capable of holding multiple sheets 3. The sheet pressing plate 7A is pivotably supported at its rear end while its front end is upwardly urged by a spring (not shown). With this structure, the sheets 3 stacked in the sheet supply tray 7 are held by the sheet pressing plate 7A with their front ends being upwardly urged.

An uppermost sheet 3 of the stack of sheets 3 loaded in the sheet supply tray 7 is pressed toward the pickup roller 10 by an urging force from the sheet pressing plate 7A. Upon rotation of the pickup roller 10, the uppermost sheet 3 is conveyed toward and between the sheet supply roller 8 and the separating pad 9. Then, when the sheet 3 is sandwiched between the sheet supply roller 8 and the separating pad 9, the topmost sheet 3 is separated from the stack of sheets 3 and supplied, one by one, by rotation of the sheet supply roller 8. The separated sheet 3 then passes the pair of paper dust removing rollers 11 so that paper dust (if any) adhering to the sheet 3 is removed therefrom. After that, the sheet 3 is further conveyed to the pair of register rollers 12A and 12B.

The register rollers 12A and 12B function as a drive roller and a following roller, respectively. The register rollers 12A and 12B may correct skewing of the sheet 3 (if any) and convey the sheet 3 onto a transfer belt (a sheet conveyor belt) 38 of the sheet conveying part 35 via a sheet supply path 14. The sheet supply path 14 in this example structure includes an arc-shaped sheet conveying path that is formed in a frame 21 of the image forming unit 20.

At a top portion in the main casing 2, a scanner portion 18 (functioning as an exposure device) is provided. The scanner portion 18 emits a laser beam L, based on predetermined image data, by color of toner, onto a surface of each photosensitive drum 30 in the image forming unit 20 using high-speed scanning. That is, in this example structure 1, four laser beams L corresponding to the respective colors are diagonally downwardly emitted from a bottom of the scanner portion 18 toward their corresponding photosensitive drums 30. Optical paths of the laser beams L are indicated by a dot and dashed line in FIG. 1. The laser beams L in at least some example structures in accordance with this invention are emitted from the scanner portion 18 and/or travel in optical paths in parallel with each other (at least in part) and/or spaced at regular intervals in a front-rear direction. Any desired scanning system 18 may be used without departing from this invention, including conventional scanning systems known and used in the art.

Inside the main casing 2 in this example structure 1, a unit accommodating portion 19 is provided below the scanner portion 18. An image forming unit 20, which can be pulled toward the front of the printer 1 and can be attached to and detached (separated) from the main casing 2, is accommodated in the unit accommodating portion 19. The image forming unit 20 of this example structure includes the frame 21, which supports the photosensitive drums 30 (functioning as image carrying members), scorotron chargers 31 (functioning as charging devices), four developing cartridges 22 (functioning as developing devices), and cleaning brushes 33.

The four developing cartridges 22 in this example image forming unit structure 20 are independently attachable to and detachable from the frame 21 of the image forming unit 20 and are provided corresponding to the respective colors of black, cyan, magenta, and yellow. Hereinafter, a description of one of the developing cartridges 22 will be made since all of these illustrated developing cartridges 22 have the same structure. The developing cartridge 22 includes a box-shaped housing 23 with an open bottom structure. The housing 23 has a toner storage chamber 24, which is filled with toner, at its upper portion. An agitator (not shown) may be provided in the toner storage chamber 24. When the agitator rotates upon input of power from a motor (not shown), toner stored in the toner storage chamber 24 is agitated. The developing cartridge 22 further includes a toner supply roller 25, a developing roller 26, and a layer-thickness regulating blade 27 under the toner storage chamber 24.

The toner supply roller 25 in this example developing cartridge structure 22 is rotatably supported by the housing 23 and includes a metal roller shaft covered with a roller portion made of conductive foam material. The toner supply roller 25 is rotated by input of power from a motor (not shown).

The developing roller 26 is disposed at a diagonally-lower-rear position with respect to the toner supply roller 25, and it is positioned in such a manner as to contact the toner supply roller 25 (e.g., such that the two rollers 25 and 26 press-deform one another). The developing roller 26 opposingly contacts its respective photosensitive drum 30, e.g., at least when the developing cartridge 22 is attached to the frame 21. The developing roller 26 of this example structure includes a metal roller shaft covered with a roller portion made of conductive urethane rubber or conductive silicone rubber (e.g., made conductive by inclusion of, for example, carbon particles). A surface of the roller portion of the developing roller 26 may be coated with a layer of urethane rubber or silicone rubber, optionally rubbers that include fluorine. During developing, a developing bias may be applied to the developing roller 26. The developing roller 26 may be rotated by input of power from a motor (not shown).

The layer-thickness regulating blade 27 of this example structure includes a blade body, made, for example, of a metal plate spring member, and a pressing portion having a generally semicircular cross-sectional shape. The pressing portion is provided at a free end of the blade body and is made of insulative silicone rubber. The layer-thickness regulating blade 27 is supported by the housing 23 above the developing roller 26 and is pressed against the developing roller 26 by elastic force of the blade body.

Toner discharged from the toner storage chamber 24 is supplied to the developing roller 26 by rotation of the toner supply roller 25. The toner may be positively charged, for example, by friction between the toner supply roller 25 and the developing roller 26. At least some of the toner supplied onto the developing roller 26 then moves between the pressing portion of the layer-thickness regulating blade 27 and the developing roller 26. In this manner, along with the rotation of the developing roller 26, the toner is uniformly regulated to a specified thickness as a thin layer that is carried on the developing roller 26.

The photosensitive element in this example image forming unit structure 20 constitutes a photosensitive drum 30 having a drum body 30A of cylindrical shape and a metallic drum shaft 30B. The drum body 30A may be formed such that its outermost layer is a positively charged photosensitive layer made of, for example, polycarbonate. Any desired types of photosensitive materials and/or photosensitive drums may be used without departing from the invention, including conventional photosensitive materials and/or drums that are known and used in the art. The drum shaft 30B may be provided at a central axis of the drum body 30A and may extend in a longitudinal direction of the drum body 30A. The drum shaft 30B is supported by the frame 21, and the drum body 30A is rotatably supported by the drum shaft 30B. With this structure, the photosensitive drum 30 is rotatable about the drum shaft 30B in the frame 21. The photosensitive drum 30 may be rotated by input of power from a motor (not shown).

The scorotron charger 31 in this example printer structure 1 is disposed facing the photosensitive drum 30 at a specified distance so as not to contact the photosensitive drum 30. The scorotron charger 30 may be located, for example, at a diagonally-upper-rear position with respect to the photosensitive drum 30. The scorotron charger 31 uniformly charges the surface of the photosensitive drum 30 by generating a corona discharge from a discharge wire, such as a tungsten wire. Any type of charging device may be used without departing from this invention, including conventional charging devices that are known and used in the art.

A cleaning brush 33 also may be provided and disposed so as to opposingly contact the photosensitive drum 30 from the rear.

The sheet conveying part 35 of this example printer structure 1 is disposed so as to be located under the image forming unit 20 when the image forming unit 20 is accommodated in the unit accommodating portion 19. This example sheet conveying part 35 includes a pair of belt support rollers 36 and 37 and the transfer belt 38. The belt support rollers 36 and 37 are spaced from each other in the front-rear direction and extend in parallel with each other. The transfer belt 38 is disposed so as to run between the pair of belt support rollers 36 and 37. Upon rotation of the rear belt support roller 36 by power from a motor, the transfer belt 38 moves in a circle around the belt support rollers 36 and 37. Inside the endless transfer belt 38, four transfer rollers 39 are arranged, e.g., at regular intervals in the front-rear direction, so as to be opposite to the corresponding photosensitive drums 30 of the image forming unit 20 while the transfer belt 38 is sandwiched between each photosensitive drum 30 and its corresponding transfer roller 39. Under the transfer belt 38, a cleaning roller 40 is provided to remove residual or stray toner (if any) adhered to the transfer belt 38. The sheet 3 discharged from the pair of register rollers 12A and 12B passes through the sheet supply path 14 and then contacts a vicinity of an upper front end of the transfer belt 38. The sheet 3 may be adhered to the upper surface of the transfer belt 38, e.g., by static electricity, and may be conveyed toward the rear of the printer 1 by circulation of the transfer belt 38.

The surface of the photosensitive drum 30 in this example structure 1 is uniformly positively charged by the scorotron charger 31 and by rotation of the photosensitive drum 30, and then, the surface is exposed to a laser beam L emitted from the scanner portion 18. In this manner, an electrostatic latent image corresponding to an image to be formed on the sheet 3 is formed on the surface of the photosensitive drum 30.

With the rotation of the developing roller 26, positively charged toner carried on the developing roller 26 makes contact with the photosensitive drum 30 and is supplied to the electrostatic latent image formed on the surface of the photosensitive drum 30. The toner is supplied to an exposed portion of the previously uniformly positively charged surface of the photosensitive drum 30, and it adheres to areas of the drum 30 where the potential has become lowered due to the exposure to the laser beam L. As a result, the electrostatic latent image on the photosensitive drum 30 becomes visible and a reversal phenomenon occurs. In this manner, a toner image is formed on the surface of the photosensitive drum 30.

The toner image carried on the photosensitive drum 30 is transferred onto recording media (e.g., a sheet 3) in this example printer structure 1 by a transfer bias applied to the transfer roller 39 while the sheet 3 passes through a transfer position between the photosensitive drum 30 and the transfer roller 39. The sheet 3 onto which the toner image has been transferred then is conveyed to a fixing part 42.

The fixing part 42 in this example printer structure 1 is provided at the rear of the sheet conveying part 35 in the main casing 2, and it includes a heat roller 43 and a pressure roller 44, which are opposite to each other. At the fixing part 42, toner transferred onto the sheet 3 is fixed thereon by heat and/or pressure. The sheet 3 onto which the toner is fixed then is conveyed by a pair of conveyor rollers 45 to a pair of discharge rollers 46 provided at an upper position of the main casing 2 in this example structure 1. The conveyor rollers 45 are disposed at a diagonally-upper-rear position with respect to the fixing part 42. The main casing 2 also may be provided with a sheet discharge tray 47, e.g., at or forming a portion of the top of the printer main casing 2. The sheet discharge tray 47 of this example structure includes a substantially horizontal portion at its front side and a downwardly inclined portion at its rear side. The inclined portion of the sheet discharge tray 47 is downwardly inclined toward the rear. Sheets 3 discharged by the discharge rollers 46 are stacked on the sheet discharge tray 47 after images are formed on the sheets 3.

Next, the structure of the image forming unit 20 will be described in more detail. As shown in FIG. 1, the frame 21 of the image forming unit 20 has a narrow box shape elongated in the printer 1 front-rear direction. The frame 21 includes a front wall 49 at its front end. In the frame 21, four partition walls 50 are arranged behind the front wall 49 at regular intervals in the front-rear direction. Between each of the opposing partition walls 50 and between the front wall 49 and the partition wall 50 opposite to it, cartridge mounting portions 51 are provided in the frame 21. The cartridge mounting portions 51 are upwardly opened and the developing cartridges 22 can be attached to and detached from the frame 21 at the respective cartridge mounting portions 51. A front surface 50A of each partition wall 50 is slightly inclined such that its upper end is tilted toward the front. A rear surface 50B of each partition wall 50 is inclined at an angle greater than the front surface 50A such that its upper end is tilted toward the front. A rear surface 49A of the front wall 49 is inclined at the same angle as the rear surfaces 50B of the partition walls 50 such that its upper end is tilted toward the front.

In a state where the developing cartridges 22 are mounted on the respective cartridge mounting portions 51, the housings 23 of the developing cartridges 22 are situated such that their rear walls extend in parallel with the opposing front surfaces 50A of the partition walls 50 and their front walls extend in parallel with the opposing rear surfaces 50B of the partition walls 50 or the opposing rear surface 49A of the front wall 49. The housing 23 walls also may be separated from the surfaces 50A and 50B of the partition walls and/or the rear surface 49A of the front wall 49, e.g., by a predetermined distance, as shown in FIG. 1. Each of the cartridge mounting portions 51 may be provided with a guide (not shown in FIG. 1) at its inner wall in order to guide the installation and removal of the developing cartridge 22 with respect to the frame 21. Accordingly, in this manner, the developing cartridges 22 may be guided in a direction along the rear surfaces 50B of the partition walls 50 or the rear surface 49A of the front wall 49 when they are attached to and detached from the cartridge mounting portions 50. In other words, in at least some example printer 1 structures, a removal direction of the developing cartridges 22 may be inclined toward a pulling direction of the image forming unit 20 (indicated by an arrow in FIG. 2) (toward the front). Furthermore, each of the cartridge mounting portions 51 may be provided with an engaging device (not shown) at its inner walls in order to maintain, at least in part, the developing cartridge 22 at an appropriate position in the cartridge mounting portion 51. When the developing cartridge 22 of this example structure 1 is installed in the cartridge mounting portion 51 and reaches the appropriate mounting position, the engaging device can be engaged with the developing cartridge 22 (e.g., elastically engaged via a spring, locked into place, etc.). When the developing cartridge 22 is to be removed from the mounting position, the engaging device can be disengaged from the developing cartridge 22.

The photosensitive drum 30 in this printer structure 1 is held at the bottom of each respective cartridge mounting portion 51 so that the photosensitive drum 30 is located near the partition wall 50 disposed at the rear of each photosensitive drum 30 when the developing cartridges 22 are mounted to the frame 21. Lower portions of the photosensitive drums 30 may slightly protrude downward from a bottom surface 21A of the frame 21. The photosensitive drums 30 are disposed so as to be opposite to the corresponding transfer rollers 39 while sandwiching the transfer belt 38 between the photosensitive drums 30 and the transfer rollers 39. Inside each of the partition walls 50 in this example image forming unit structure 20, at the lower portions thereof, scorotron chargers 31 and cleaning brushes 33 are provided around the photosensitive drum 30.

The frame 21 in this example printer structure 1 is formed with an overhang portion 52, e.g., along an entire lower front end of the front wall 49. This overhang portion 52 juts out downward from the bottom surface 21A of the frame 21. One register roller (e.g., the following roller 12B) of the pair of register rollers 12A and 12B is held by a rear surface of the overhang portion 52 in this example structure. The overhang portion 52 is integrally provided with a pair of guides 14A and 14B at its lower portion. The clearance between the pair of guides 14A and 14B provides a substantially arc-shaped sheet supply path 14 that is upwardly curved, as shown in FIGS. 1 and 2. Recording media (e.g., a sheet 3) conveyed by the pair of register rollers 12A and 12B passes through the sheet supply path 14 while being guided by the pair of guides 14A and 14B, and thus the sheet 3 is supplied onto the transfer belt 38. Two rear foot portions 53 are provided at a rear lower end of the right and left sidewalls 21B of the frame 21 so as to downwardly protrude from the bottom surface 21A of the frame 21. In this manner, when the image forming unit 20 of this example structure is placed on a flat surface, such as a tabletop or installation plane T (e.g., see FIG. 3), the rear foot portions 53 and the overhang portion 52 (e.g., functioning as an interference preventing device) contact the surface so that the bottom surface 21A of the frame 21 is kept at a position elevated and separated from the surface. In this manner, the photosensitive drums 30 are maintained at an elevated level where the photosensitive drums 30 do not contact and/or otherwise interfere with the surface (e.g., thereby preventing damage to the drums, preventing debris from contacting the drums, and/or preventing toner from depositing on the underlying surface). The interference preventing device (e.g., overhang portion(s) 52 and foot portion(s) 53) may maintain the photosensitive drum 30 surfaces at any desired elevated level or distance with respect to the resting surface without departing from this invention.

In at least some structures according to this invention, a rail-like guiding device (not shown) may be provided between the image forming unit 20 and the main casing 2 (e.g., akin to conventional drawer guides known and used in the art and/or in the furniture arts). The image forming unit 20 may be capable of sliding in the front-rear directions of the printer 1 along the guiding device. A retaining protrusion 55 may be provided, e.g., at each sidewall 21B of the frame 21, so as to protrude upward from an upper rear end of each sidewall 21B. A fall preventing portion 56 also may be provided at the inner wall of the unit accommodating portion 19 in the main casing 2 so as to protrude downward from each side of the front end of the inner wall, e.g., as shown in FIG. 2. The fall preventing portions 56 in this example structure are engageable with the respective retaining protrusions 55 of the frame 21 of the image forming unit 20, and together these structures function as a "fall preventing device." When the image forming unit 20 is pulled from an attached position (as shown in FIG. 1) to a pull-stop position (as shown in FIG. 2), the retaining protrusions 55 contact and engage with the rear surfaces of the fall preventing portions 56 so that the image forming unit 20 is prevented from falling from the main casing 2. At the pull-stop position in this example arrangement, the frame 21 may be downwardly tilted by its own weight such that its front end side is positioned at a level that is slightly lower than the rear end side. Thus, the retaining protrusions 55 and the fall preventing portions 56 are maintained in the engaged state shown in FIG. 2. In addition, when the image forming unit 20 is located at the pull-stop position, the upper portion of the frame 21 is exposed so that the developing cartridges 22 can be attached to and/or removed from the frame 21 of the image forming unit 20. Further, at the pull-stop position, the front end (e.g., the overhang portion 52) of the frame 21 protrudes outward or toward the front more than the front end (the top end in this example) of the front cover 6 (which is located at a downwardly rotated uncovering position), which enables easy user interaction with the image forming unit 20.

A substantially C-shaped handle member 58 is attached to the frame 21 of the image forming unit 20 in this example structure in a manner so as to straddle the frame 21. The handle member 58 includes a grip portion 58A, which extends in a right-left direction, and a pair of arm portions 58B, which extend in the front-rear direction from each end of the grip portion 58A in parallel with each other. Each of the arm portions 58B is attached to a shaft portion 59 protruding from each sidewall 21B of the frame 21 at a position slightly shifted to the grip portion 58A side from its rear end. In this manner, the handle member 58 may be mounted so as to be capable of pivoting about the shaft portions 59. The shaft portions 59 are provided in this example frame structure 21, on respective sides of the frame 21, at positions shifted to the rear of the frame 21 from the middle position thereof in the front-rear direction and near the upper edge of the frame 21. The handle member 58 is capable of pivoting between a pulling position (see FIG. 2) where the arm portions 58B extend substantially horizontally and the grip portion 58A protrudes toward the front more than the front wall 49 of the frame 21 and a lifting position (see FIG. 3) where the arm portions 58B incline upwardly and the grip portion 58A is located at a position above the frame 21, more close to the middle position of the frame 21 in the front-rear direction (e.g., closer to the center of gravity of the frame 21 in the front-rear direction) than when the handle member 58 is located at the pulling position. A stopper 60 is provided in this example structure under each shaft portion 59 so as to protrude from each sidewall 21B of the frame 21. When the handle member 58 is located at the lifting position, the rear end portions of the arm portions 58B (the portions existing behind the shaft portions 59) contact their respective stoppers 60 so that rotation of the handle member 58 in a direction so as to move the grip portion 58A toward a direction reverse to the pulling position (e.g., in a counterclockwise direction in FIG. 3) is restricted by the stoppers 60. Thus, a user can lift the image forming unit 20 by holding the grip portion 58A while the handle member 58 is located at the lifting position (and stopped from over rotation by stoppers 60). The frame 21 may be designed such that while the image forming unit 20 is being lifted (as will be described in more detail later), a torque is generated in a direction to press the stoppers 60 against the handle member 58 regardless of the presence or absence (e.g., the installation condition) of the developing cartridges 22 (e.g., regardless of the number of developing cartridges 22 being attached to the frame 21) and/or regardless of the amount of toner contained in the various developing cartridges 22 in the frame 21.

To pull the image forming unit 20 out from the main casing 2 from the state shown in FIG. 1, first, the user opens the front cover 6, puts his/her fingers on the grip portion 58A of the handle member 58 located at the pulling position, and pulls the image forming unit 20 in a direction toward the front. When the image forming unit 20 reaches the pull-stop position, as shown in FIG. 2, the retaining protrusions 55 contact and engage with the respective fall preventing portions 56 so that the image forming unit 20 is stopped at the pull-stop position and prevented from falling from the main casing 2. As described above, when the image forming unit 20 is pulled to the pull-stop position, if necessary or desired, the developing cartridges 22 can be replaced with new ones. The developing cartridges 22 can be removed or detached from the frame 21, e.g., by pulling the developing cartridges 22 diagonally forward and upward with respect to the frame 21, and they can be attached to the frame 21, e.g., by pushing the developing cartridges 22 diagonally downward in the direction reverse to the cartridge removal direction. Therefore, operability can be improved when replacing the developing cartridges 22 as compared with a case where developing cartridges are attached and detached with respect to a frame in a vertical direction. In addition, as described above, in this example structure the frame 21 includes at least a portion of the sheet supply path 14. With this example structure, in the case where a paper jam occurs while the sheet 3 passes through the sheet supply path 14, the jammed sheet 3 can be easily removed therefrom because the jammed sheet 3 is moved forward and exposed together with the frame 21 when the frame 21 is pulled toward the front. In addition, when the image forming unit 20 is located at the pull-stop position, the substantially front part of the sheet supply path 14 protrudes out from the casing further than the front end (e.g., the top end) of the front cover 6. Therefore, a sheet 3 jammed in the sheet supply path 14 can be easily removed therefrom without interference from the cover 6.

Figure 3:
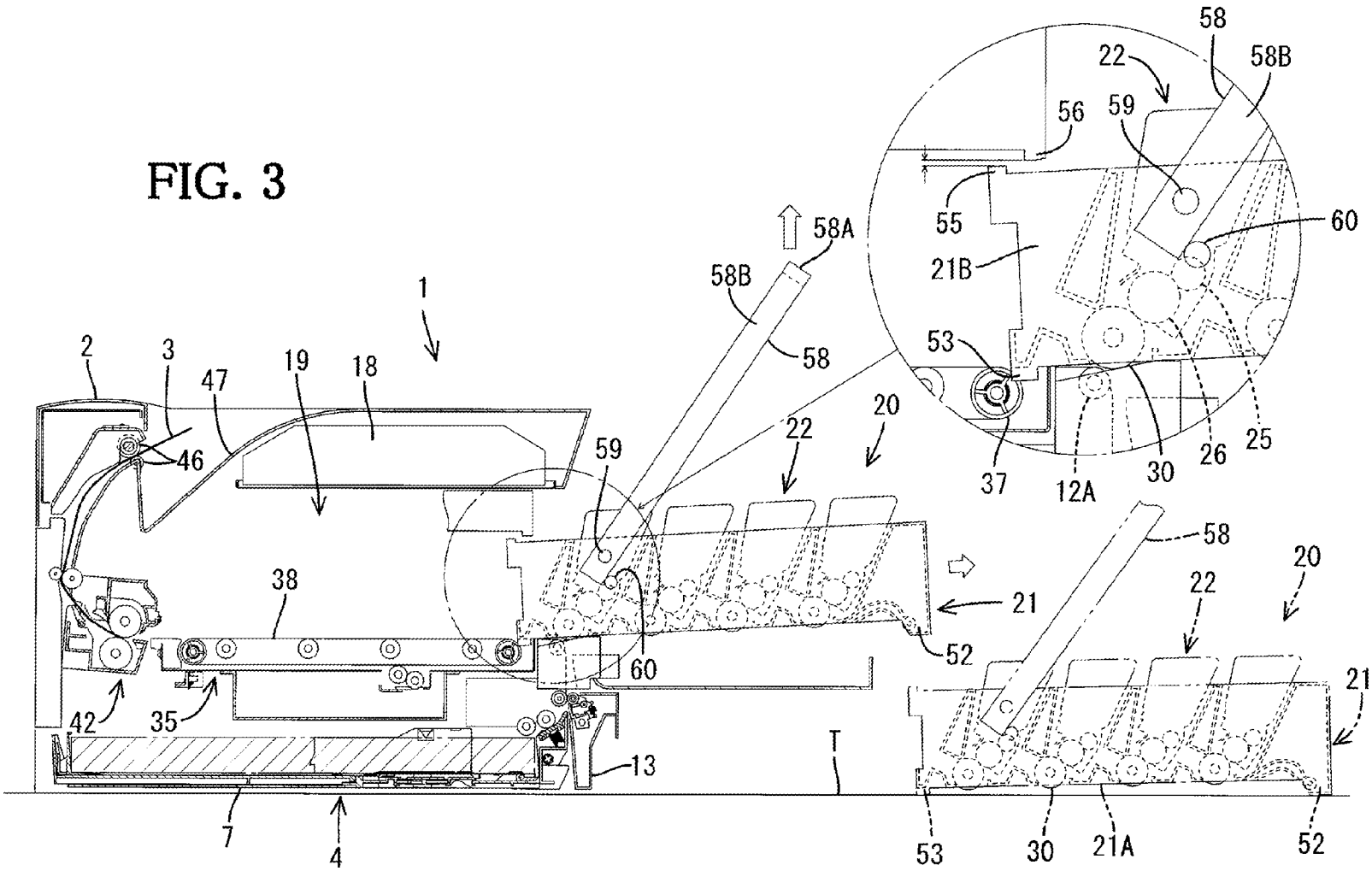
FIG. 3 is a sectional side view of the example laser printer of FIG. 1 showing the process of separating the image forming unit from the main casing.

To separate or detach the image forming unit 20 from the main casing 2 in this example printer structure 1, first, the user rotates the grip portion 58A of the handle member 58 to the lifting position from the pulling position (if necessary). When the handle member 58 reaches the lifting position, the stoppers 60 contact the respective arm portions 58B to restrict further rotation of the handle member 58. Then, when the user tries to further rotate the grip portion 58A from this state, as shown in FIG. 3, the frame 21 is tilted such that its front end side is slightly lifted while rotating about the lower edge of the rear end side. With this lifting or tilting, the retaining protrusions 55 are diagonally downwardly moved toward the rear and thus are disengaged and separated from the fall preventing portions 56.

In this state, when the user further pulls the image forming unit 20 toward the front of the printer 1 while holding the grip portion 58A, the rear end of the frame 21 comes out of the unit accommodating portion 19 of the main casing 2, and the user can lift the image forming unit 20 separately. As described above, the grip portion 58A can be moved easily between the pulling position and the lifting position, and in this manner, the user can smoothly perform a series of operations from the pulling the image forming unit 20 out of the casing 2 to lifting and disengaging it from the casing 2 without changing his/her holding position on the grip portion 58A.

Figure 4A:
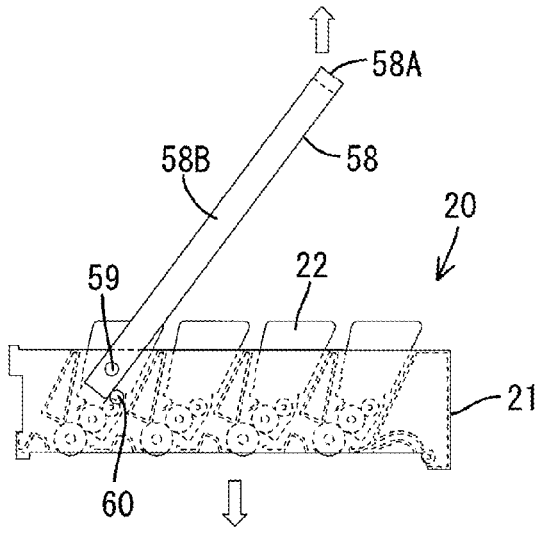
FIGS. 4A to 4C are explanatory diagrams showing a relationship between an installation condition of the developing cartridges and various acting forces.
Figure 4B:
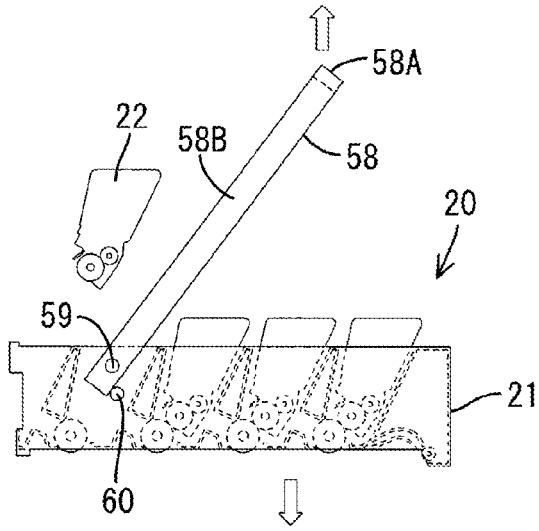
Figure 4C:
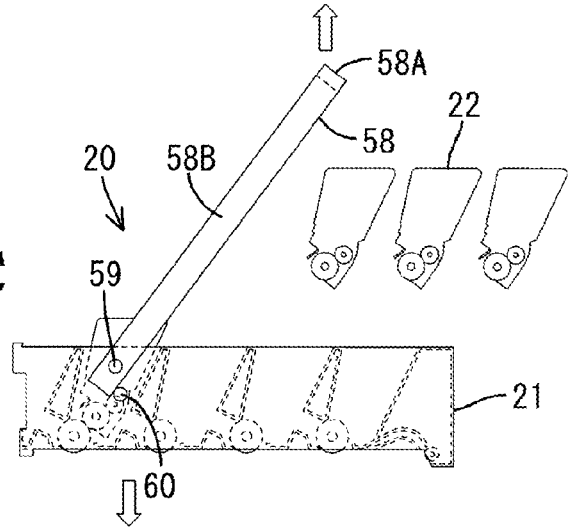

When the image forming unit 20 is lifted by holding the grip portion 58A in the manner described above, a torque is generated between the frame 21 and the handle member 58 in a direction to press the stoppers 60 against the handle member 58 at all times, regardless of the number of developing cartridges 22 attached to the cartridge mounting portions 51 in the image forming unit 20. For example, as shown in FIG. 4A, when the image forming unit 20 is lifted while four toner-filled developing cartridges 22 are attached to the frame 21, the center of gravity of the frame 21 (the center of gravity of members other than the handle member 58 in the image forming unit 20 is indicated in FIG. 4A by a downward-pointing arrow) is maintained near the center of the frame 21 in the front-rear direction. Additionally, because the shaft portions 59 of the handle member 58 are provided at positions at the rear of the center of gravity of the frame 21, torque is generated between the frame 21 and the handle member 58 in the direction so as to press the stoppers 60 against the handle member 58 (e.g., in a direction to rotate the frame 21 in a clockwise direction in FIG. 4A). Thus, the frame 21 is maintained in a substantially horizontal posture when lifted by the handle member 58. As shown in FIG. 4B, when the image forming unit 20 is lifted with three developing cartridges 22 attached to the frame 21 (e.g., with the developing cartridge 22 at the rearmost position removed from the frame 21), the center of gravity of the frame 21 is brought somewhat forward from the state of FIG. 4A as shown by a downward-pointing arrow in FIG. 4B. Nonetheless, torque is generated between the frame 21 and the handle member 58 in the direction to press the stoppers 60 against the handle member 58, and this torque maintains the frame 21 in a substantially horizontal posture. As shown in FIG. 4C, the handle member 58 further may be positioned such that even when the image forming unit 20 is lifted when a single developing cartridge 22 is attached at the rearmost position and the other three developing cartridges 22 are removed from the frame 21 (e.g., the center of gravity of the frame 21 is brought rearward of the state shown in FIG. 4A to the state shown in FIG. 4C), the center of gravity of the frame 21 may be maintained in front of the position of the shaft portions 59 as shown by a downward-pointing arrow in FIG. 4C. Therefore, the direction of the torque generated in the situation shown in FIG. 4C is the same as that of the torque generated in the above-described situations shown in FIGS. 4A and 4B, so that the frame 21 may be maintained in a substantially horizontal posture. As described above, the direction of the torque is not changed even when the number of developing cartridges 22 attached in the frame 21 and/or the positions of the developing cartridges 22 attached in the frame 21 are changed, so that the frame 21 can be stably lifted by the handle member 58 and the developing cartridges 22 can be prevented from falling from the frame 21 (e.g., by the frame 21 turning upside down due to unevenly distributed weight). Even when the weight of the developing cartridges 22 varies due to changes in the toner amount remaining therein, the direction of the torque stays constant at all times, so that the frame 21 can be stably lifted and the developing cartridges 22 do not fall from the frame 21 due to the frame 21 turning upside down.

As described above, the image forming unit 20 can be separated from the laser printer 1 and carried to different places, e.g., places distance from the main casing 2 of the laser printer 1. When the image forming unit 20 is placed on a surface (such as a table top or flat installation plane T as shown in FIG. 3), the rear foot portions 53 and the overhang portion 52 contact the surface, and the photosensitive drums 30 are held at elevated positions separated from the surface (as indicated by a double-dot and dashed line in FIG. 3). With this structure, contact and/or interference between the photosensitive drums 30 and the surface can be avoided, e.g., so that maintenance, part replacement, jam detection, and the like can be performed without concern for damage of the photosensitive drums 30 due to contact and/or interference with other surfaces or members. Also, when the image forming unit 20 is separated from the main casing 2, the front of the main casing 2 may remain opened, e.g., so that clearing of paper jams, repair, and/or maintenance, such as part replacement, can be performed inside the casing 2. As a more specific example, in this illustrated example structure, when the image forming unit 20 is separated from the main casing 2, the image forming unit 20 (including the photosensitive drums 30 in this example structure) can be separated from the transfer belt 38 that transfers sheets 3, so that paper jam clearing and/or replacement of the transfer belt 38 can be easily performed. When the photosensitive drums 30 of the image forming unit 20 are replaced with new ones, if desired, the whole frame 21 can be replaced with a new one. Alternatively, as described later in conjunction with other illustrated examples, various parts, such as the photosensitive drums 30 and/or the scorotron chargers 31, may be arranged so as to be separately attachable and detachable with respect to the frame 21 and/or the developing cartridges 22. In this manner, each of these parts may be replaced with a new one independently, at any appropriate time, without dependence upon the timing of replacement of other parts.

The fall preventing device (e.g., the retaining protrusions 55 and the fall preventing portions 56), which prevents the image forming unit 20 from falling from the pull-stop position in the main casing 2, is provided so that the image forming unit 20 is stopped at the pull-stop position when it is pulled toward the front of the printer structure 1. With this device and these structures, the image forming unit 20 is prevented from falling from the main casing 2. Therefore, users are less likely to need to expend extra effort putting the image forming unit 20 back in the main casing 2 after the image forming unit 20 accidentally and undesirably separates from the main casing 2. Also, damage to the image forming unit 20 or parts contained therein can be prevented through use of the fall prevention device.

As will be described in more detail below in conjunction with the example structures illustrated in FIGS. 5 through 6B, the grip portion (e.g., 58A) may serve other functions as well. For example, if desired in accordance with at least some examples of this invention, the grip portion 58A may serve as a releasing portion for releasing the retaining action of the fall preventing device, e.g., so that disengagement of the image forming unit 20 from the fall preventing device (and thus separation of the image forming unit 20 from the printer 1) can be smoothly performed.

Also, if desired, the pulling direction of the image forming unit 20 may be the same as the pulling direction of the sheet supply tray 7, so that the laser printer 1 can be easily refilled and does not require a large surrounding volume of empty space. Moreover, this feature allows the overall printer 1 to be more easily moved without one or more of the sheet supply tray 7 and/or the image forming unit 20 falling or moving.

Furthermore, if desired, in accordance with at least some example structures according to this invention, the developing cartridges 22 (e.g., functioning as a developing device) and the photosensitive drums 30 may be completely separate parts, such that only one of the developing cartridges 22 need be replaced with a new one at a given time (e.g., when toner runs low). Use of an individual photosensitive drum 30 may continue independent of and/or irrespective of the use, condition, and/or replacement of the various developing cartridges 22.

Figure 5:
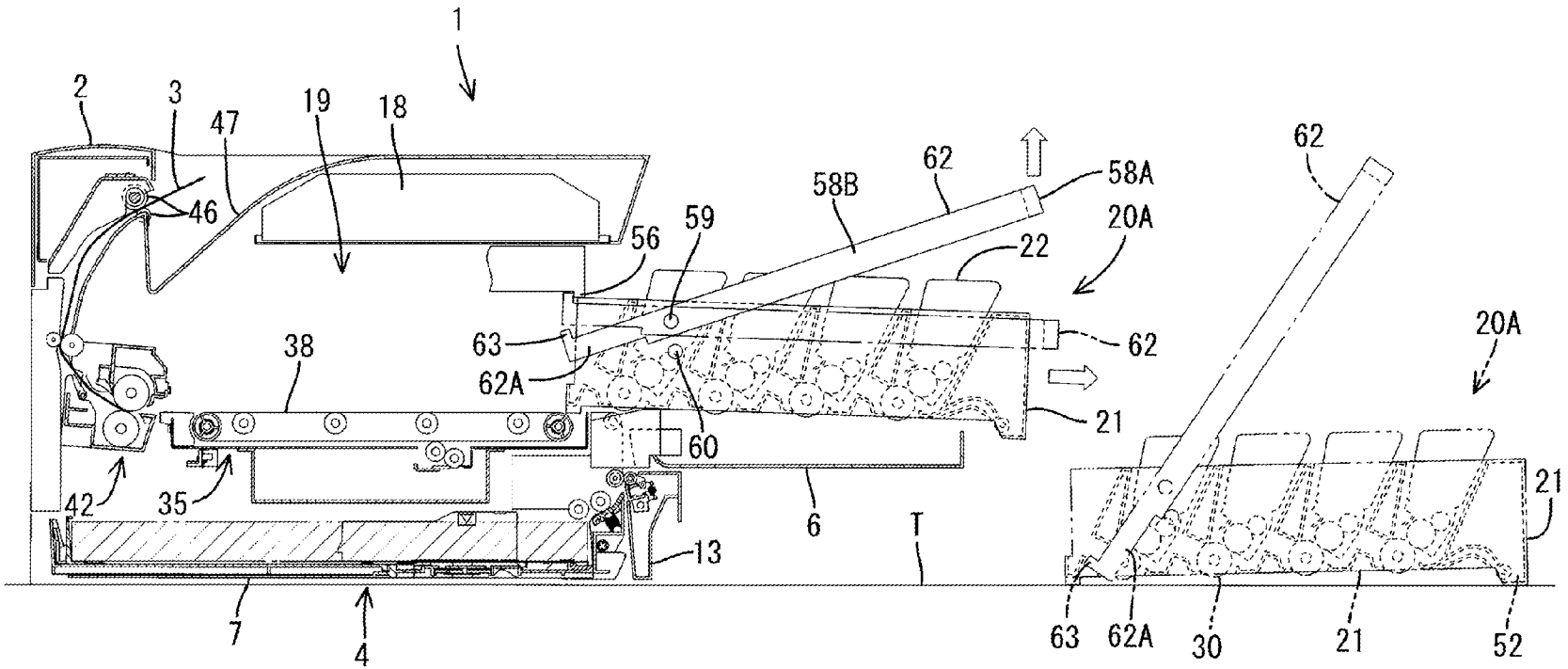
FIG. 5 is a sectional side view of an example laser printer according to the invention showing another example process of separating an image forming unit from the main casing.

Referring to FIG. 5, a variation of the example printer structure 1 of FIGS. 1 through 4C will be described. In this variation, a handle member 62 includes arm portions 58B provided with extended portions 62A extending from the rear ends of the arm portions 58B. In this structure 1, instead of providing the retaining protrusions 55 at the sidewalls 21B of the frame 21 as shown in the example structure of FIGS. 1 through 4C, retaining protrusions 63 (functioning as part of the fall preventing device) are provided as part of the extended portions 62A of the handle member 62. As illustrated in FIG. 5, the retaining protrusions 63 are designed so as to protrude upward from ends of the extended portions 62A and engage with fall preventing portions 56 of the casing 2 when the handle member 62 is located at the pulling position.

To pull an image forming unit 20A of this example structure from the attached position in the main casing 2, first, the user holds the grip portion 58A of the handle member 62 located at the pulling position and pulls the image forming unit 20A toward the front. When the image forming unit 20A reaches the pull-stop position, the retaining protrusions 63 contact and engage with the fall preventing portions 56 of the main casing 2 so that the image forming unit 20A cannot be further pulled toward the front (see the handle member 62 indicated by a double-dot and dashed line in FIG. 5). In this state, when the grip portion 58A is moved upward, the retaining protrusions 63 move downward to disengage from the fall preventing portions 56 (see the handle member 62 indicated by a solid line in FIG. 5). Then, when the handle member 62 is positioned at the lifting position (where the arm portions 58B of the handle member 62 engage the stopper members 60), the image forming unit 20A can be lifted and separated from the main casing 2. Using this example structure, generally the same effects as those obtained by the example structures of FIGS. 1 through 4C can be obtained.

Figure 6A:
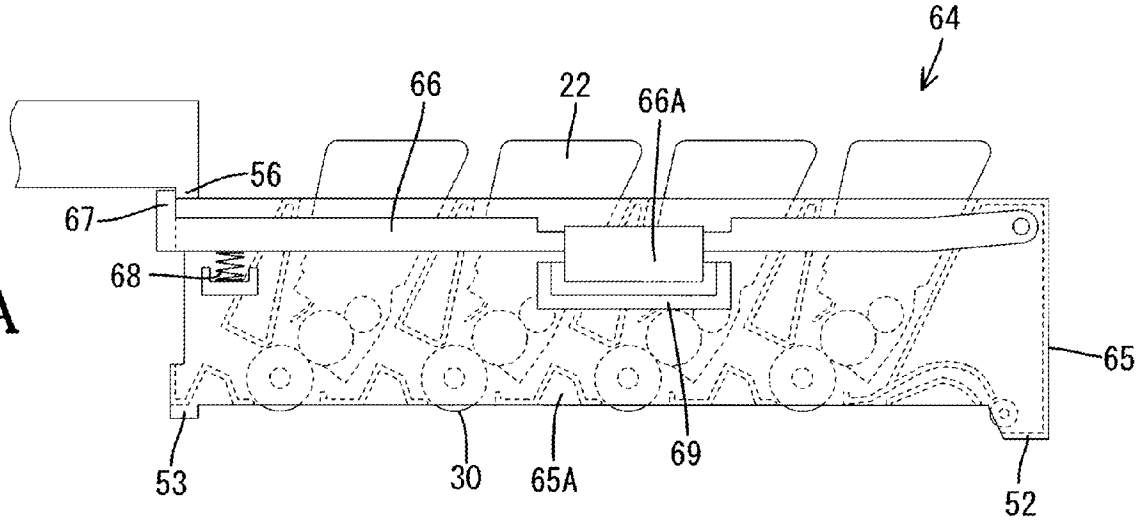
FIGS. 6A and 6B are side views showing an example schematic structure of an image forming unit according to another example of this invention.
Figure 6B:
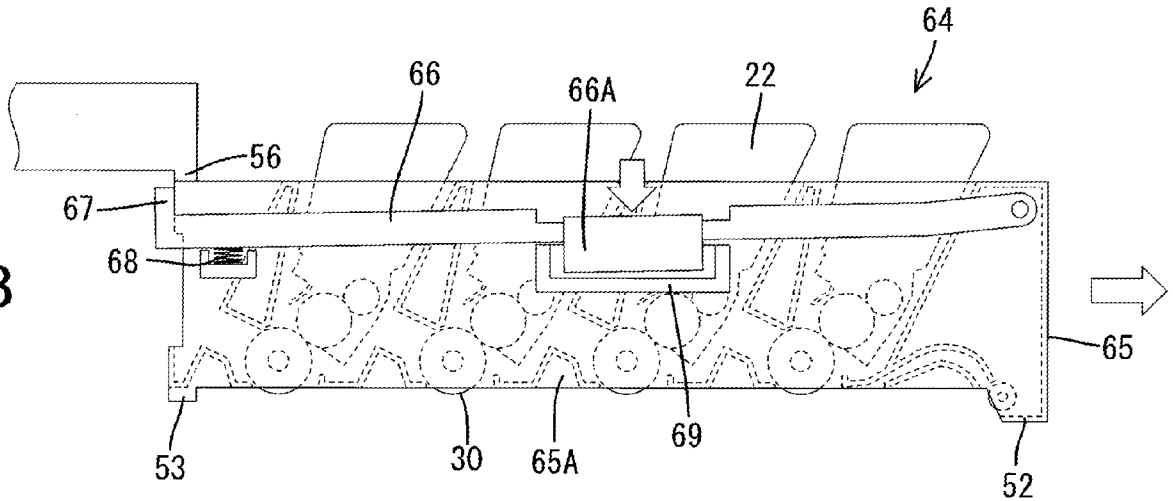

Referring to FIGS. 6A and 6B, another example of an image forming unit handle member will be described. In the following description, the same parts as those present in the description above are designated with similar reference numerals, and detailed explanations for those parts will be omitted. As will be described below, in this example structure, the movable grip portions (e.g., grip portions 66A) also serve as releasing portions for releasing the retaining of the fall preventing device, so that disengagement of the fall preventing device and carrying of the image forming unit 64 can be smoothly performed.

This example image forming unit 64 is provided with arm members 66 attached to the right and left sidewalls 65A of a frame 65 of the image forming unit 64 (only one arm member 66 is shown in FIGS. 6A and 6B). These arm members 66 extend substantially in the front-rear direction. The pair of arm members 66 may be rotatably attached such that their front ends are supported at the upper front end of the sidewalls 65A of the frame 65 and such that they are movable between a locked position and an unlocked position. At the locked position, as shown in FIG. 6A, the arm members 66 extend in substantially the horizontal direction. At the unlocked position, as shown in FIG. 6B, the arm members 66 are inclined somewhat such that their rear ends slightly descend. The arm members 66 in this example structure include retaining protrusions 67 (functioning as part of the fall preventing device), which protrude upward from their rear ends at positions behind the rear end of the frame 65. When the arm members 66 are located at the locked position, the retaining protrusions 67 are positioned to engage with rear surfaces of the fall preventing portions 56 of the main casing 2, as shown in FIG. 6A. When the arm members 66 are located at the unlocked position, the pair of arm members 66 descend somewhat so that engagement of the retaining protrusions 67 and the fall preventing portions 56 is released. Each of the sidewalls 65A of the frame 65 in this example structure includes a spring member 68 near the rear end portions of the image forming unit 64. The spring members 68 are capable of urging the arm members 66 upward to bias and maintain the arm members 66 at the locked position. Each of the arm members 66 in this example structure is provided with a movable grip portion 66A at substantially its middle portion in the front-rear direction. The movable grip portion 66A projects outwardly with respect to the frame 21. In addition, a fixed grip portion 69 having a substantially C-shaped cross section is provided under each movable grip portion 66A so as to protrude from each sidewall 65A of the frame 65. Pairs of the movable grip portion 66A and the fixed grip portion 69 are disposed so as to be symmetrical with respect to a central axis of the frame 65 extending along the frame's pulling direction.

When the image forming unit 64 is pulled from the main casing 2 to the pull-stop position, as shown in FIG. 6A, the retaining protrusions 67 of the arm members 66 contact and engage with the fall preventing portions 56 of the main casing 2 so that the image forming unit 64 is prevented from falling from the main casing 2. To completely separate the image forming unit 64 from the main casing 2, the user holds both pairs of the movable grip portions 66A and the fixed grip portions 69 provided on the sides of the image forming unit 64 with his/her hands from above and squeezes the grip portions 66A and 69 together to move the movable grip portions 66A toward the fixed grip portions 69 as shown in FIG. 6B. By doing so, the arm members 66 rotate downward from the locked position to the unlocked position, so that the engagement of the retaining protrusions 67 and the fall preventing portions 56 is released. In this state, when the user further pulls the image forming unit 64 toward the front while holding the movable and fixed grip portions 66A and 69, respectively, the image forming unit 64 can be completely separated from the main casing 2.

According to this illustrated example structure, the pairs of movable grip portions 66A and fixed grip portions 69, which function as grip portions for lifting, are provided on both sides of the frame 65 so as to be disposed on the both sides of the central axis of the frame 65 extending along the pulling direction of the frame 65. With this structure, the user can firmly hold the image forming unit 64 with his/her hands. If desired, another grip portion may be provided, e.g., at the front of the image forming unit, e.g., to act as a grip for use in pulling the image forming unit from the casing 2.

Figure 7:
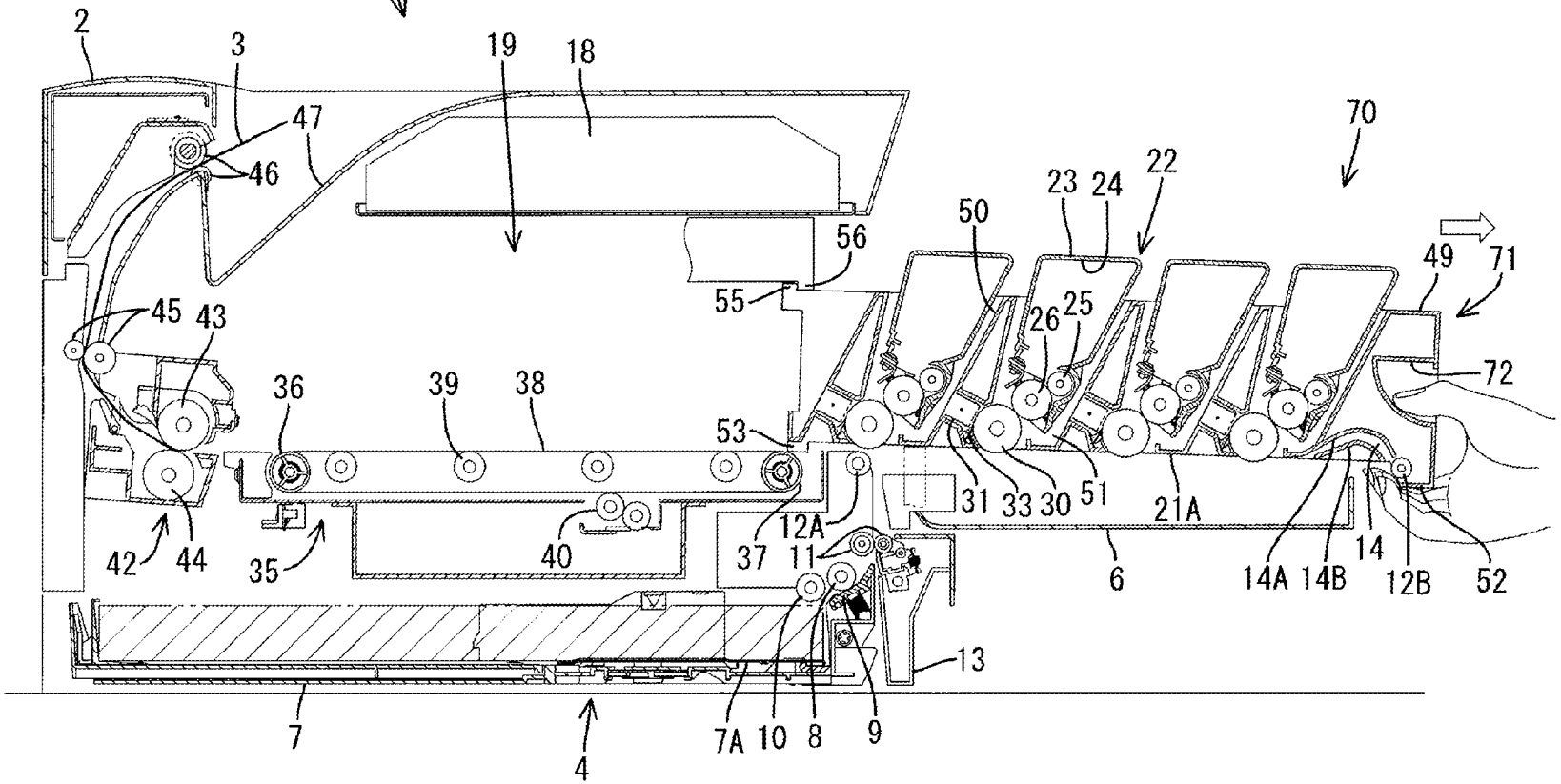
FIG. 7 is a sectional side view of an example laser printer according to the invention in which an image forming unit is pulled from a main casing of the laser printer.
Figure 8:
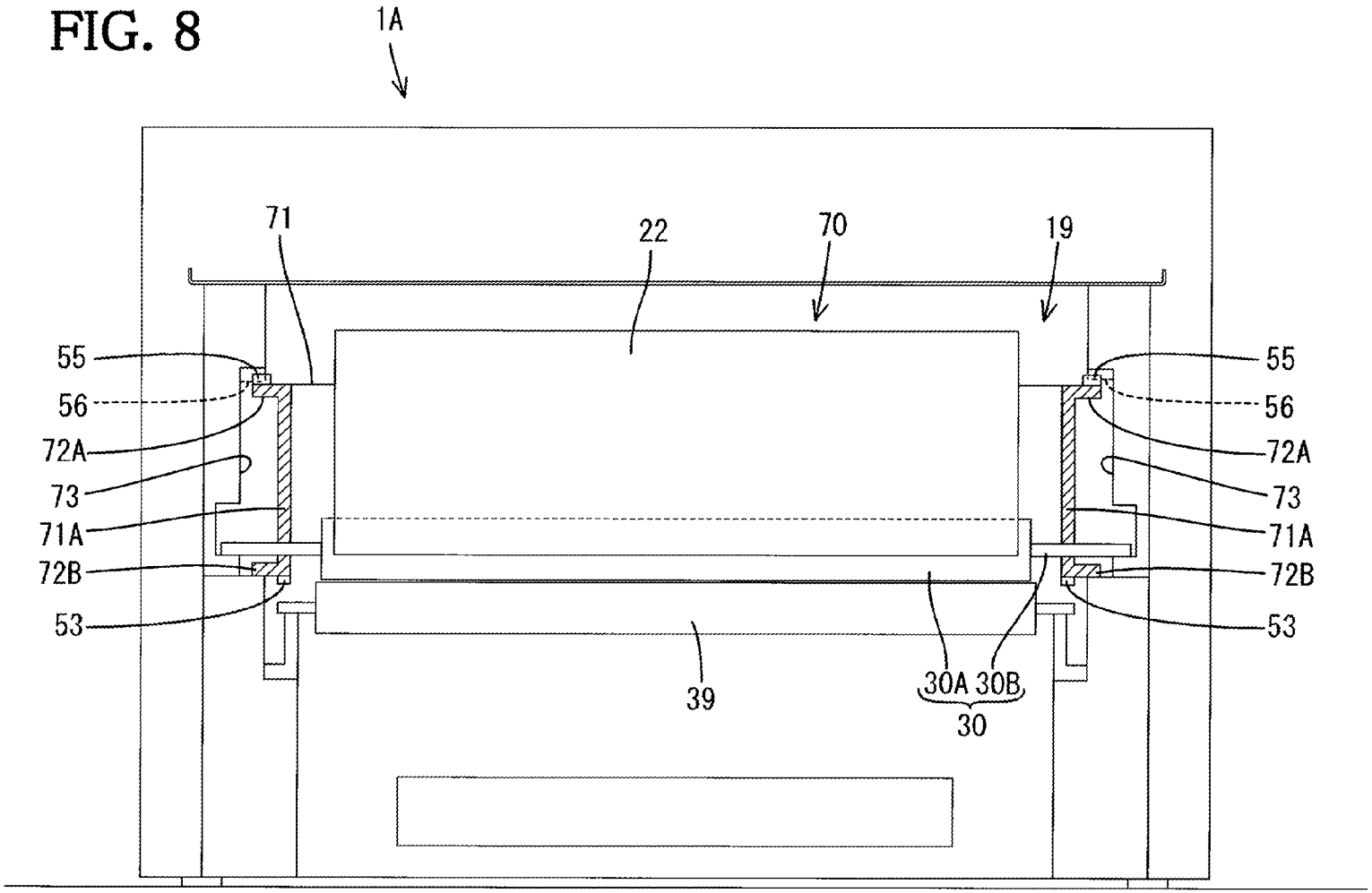
FIG. 8 is a sectional front view of an example guiding device that may be used in various printer structures according to examples of the invention.

Referring to FIGS. 7 and 8, another example structure according to the invention will be described. Again, in the following description, the same parts as those described for the various structures above are designated with similar reference numerals, and more detailed explanations for these parts will be omitted.

As shown in FIG. 7, an image forming unit 70 used for a laser printer 1A or other image forming apparatus is provided at its front wall 49 with a recessed grip portion 72, which is structured and arranged to be held by the user when the image forming unit 70 is pulled toward the front and/or removed. A guiding device that guides the movement of the image forming unit 70 is provided between the image forming unit 70 and the main casing 2. FIG. 8 is a front sectional view of the laser printer 1A illustrating at least portions of the guiding device. In FIG. 8, the near side of the drawing will be referred to as the front of the laser printer 1A, the far side of the drawing will be referred to as the back or rear of the laser printer 1A, and the right and left of the drawing will be referred to as the right and left of the laser printer 1A, respectively. As shown in FIG. 8, each sidewall 71A of the frame 71 is provided with a pair of guide rails 72A and 72B that extend in the front-rear direction. The guide rails 72A and 72B project horizontally outward from upper and lower ends of the frame 71 base portion, respectively. The right and left inner walls of the unit accommodating portion 19 of the main casing 2 are provided with guide grooves 73 with which the guide rails 72A and 72B engage. The guide grooves 73 extend in the front-rear direction in the inner walls of the unit accommodating portion 19. The frame 71 is slidingly guided in the unit accommodating portion 19 in the front-rear direction by engaging the right and left guide rails 72A and 72B in the respective guide grooves 73. In this illustrated example structure, the retaining protrusions 55 are provided at the upper rear ends of the upper guide rails 72A, and the fall preventing portions 56 are provided at the front ends of the guide grooves 73.

To pull the image forming unit 70 from the main casing 2, the user holds the grip portion 72 and pulls the image forming unit 70 toward the front of the printer 1A. When the image forming unit 70 reaches the pull-stop position, as shown in FIG. 7, the retaining protrusions 55 contact and engage with the respective fall preventing portions 56 of the main casing 2 so that the image forming unit 70 is prevented from falling from the main casing 2. In this state, the front end portion of the frame 71 protrudes toward the front more than the front end (i.e., the top end in this illustrated example) of the front cover 6 that is in the open position (i.e., located at the uncovering position). To separate the image forming unit 70 from the main casing 2 in the above-described state, the user holds the grip portion 72 and moves the grip portion 72 upward to incline the frame 71 such that its front end is positioned at a higher level than its rear end. By doing so, the retaining protrusions 55 move downward and separate from the fall preventing portions 56, and thus the engagement therebetween is released. In this released state, the frame 71 can be separated from the main casing 2 by further moving the image forming unit 70 toward the front while maintaining the frame 71 in the inclined posture.

In this illustrated example structure 1A, when the image forming unit 70 is located at the pull-stop position, the grip portion 72 provided at the front end of the frame 71 extends or protrudes toward the front a distance further than the front end (i.e., the top end in this example) of the front cover 6 that is opened in the pulling direction of the image forming unit 70A. Through this arrangement, the user can easily hold the grip portion 72 and make the necessary movements to remove the image forming unit 70 from the casing 2. Therefore, the image forming unit 70 can be easily separated from the main casing 2 and can be easily pushed into the unit accommodating portion 19.

Figure 9:
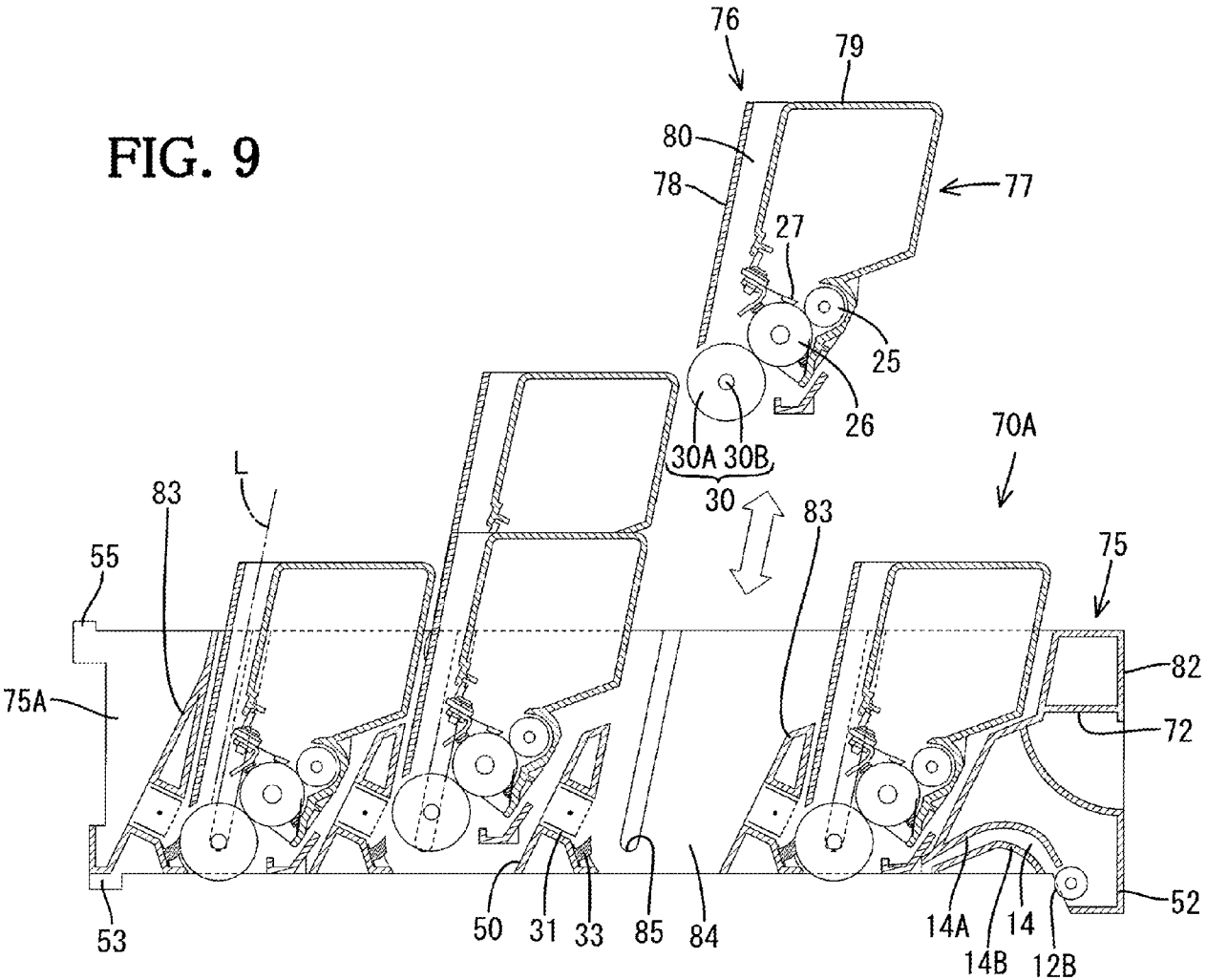
FIG. 9 is a sectional side view of an example image forming unit according to another example of this invention.

Referring to FIG. 9, further example variations or features of example structures according to this invention will be described.

In various example structures according to the invention described above, the developing cartridges 22 are capable of being attached and detached with respect to the frame 21. In the example structure of FIG. 9, four cartridges 76 are provided, each including a group of: (a) a developing cartridge 77 (functioning as a developing device) and (b) a photosensitive drum 30. The cartridges 76 are attachable and detachable with respect to a frame 75 of an image forming unit 70A. Hereinafter, a description of one of the cartridges 76 will be made, and the reader will understand that, in this example structure, all of the remaining cartridges 76 have the same structure. The cartridge 76 includes a cartridge frame 78 that holds a photosensitive drum 30 at its bottom. The developing cartridge 77 is supported in the cartridge frame 78 so as to be capable of being attached and detached with respect to the cartridge frame 78. The photosensitive drum 30 and the developing roller 26 provided in the developing cartridge 77 are held while being press-contacted with each other. The cartridge 76 has a slit 80 defined between a rear wall of a housing 79 of the developing cartridge 77 and the cartridge frame 78. The slit 80 is provided so as to extend from the upper end of the cartridge 76 to the upper surface of the photosensitive drum 30. A laser beam L emitted from the scanner portion 18 passes through the slit 80 to reach the photosensitive drum 30.

In the frame 75, four partition walls 83 are arranged at regular intervals behind a front wall 82 of the frame 75. Between each of the opposing partition walls 83 and between the front wall 82 and the partition wall 83 opposite to the front wall 82, upwardly-opened cartridge mounting portions 84 are provided. The cartridges 76 can be attached and detached with respect to the respective cartridge mounting portions 84. In this illustrated example structure 70A, the front three of the partition walls 83 are shorter in height than the frame 75, so that the cartridge mounting portions 84 communicate with and/or are open to each other at their upper portions. At the bottom of each partition wall 83, a scorotron charger 31 and cleaning brush 33 are disposed so as to be located around the photosensitive drum 30 when the cartridge 76 is attached to the frame 75. Both right and left sidewalls 75A of the frame 75 include guide grooves 85 with which the drum shafts 30B of the photosensitive drums 30 (or other desired structures as part of the cartridge 76) are engaged. The guide grooves 85 extend diagonally upwardly from the lower portions of the sidewalls 75A toward the front and their upper ends are opened at the upper edges of the sidewalls 75A. During installation and removal of the cartridge 76 with respect to the frame 75, the drum shaft 30B of the photosensitive drum 30 (or other desired structure(s)) is guided along the guide grooves 85. In this manner, the installation and removal of the cartridge 76 is guided. As shown, a removal direction of the cartridges 76 extends diagonally forward (toward the pulling direction of the frame 75). The installation/removal direction of the cartridges 76 in this example structure (as indicated by a double-headed arrow in FIG. 9) is substantially parallel to an extending direction of the slit 80 and/or at least a portion of the optical path of a laser beam L to be emitted from the scanner portion 18 for exposing the photosensitive drum 30 (the term "substantially parallel," as used in this context, includes parallel).

As noted above and illustrated in FIG. 9, the guide grooves 85 may be oriented at an inclined angle with respect to a line connecting or a plane containing the photosensitive drum shafts 30B when the photosensitive drums 30 are mounted in the image forming unit 70A. Any inclined angle (e.g., greater than 0° and less than 90°) may be used without departing from the invention. In some examples, the angles between the guide grooves 85 and a line connecting or a plane containing the drum shafts 30B may be in the range of 45° to 90°, or even in the range of 65° to 90°. In the illustrated example structure, the angle is about 80°.

In this example structure, each of the cartridges 76 includes both a developing cartridge 77 and a photosensitive drum 30. Therefore, in this example structure, both the developing cartridge 77 and the photosensitive drum 30 will be replaced simultaneously with new ones (e.g., when toner runs out, etc.).

Figure 10:
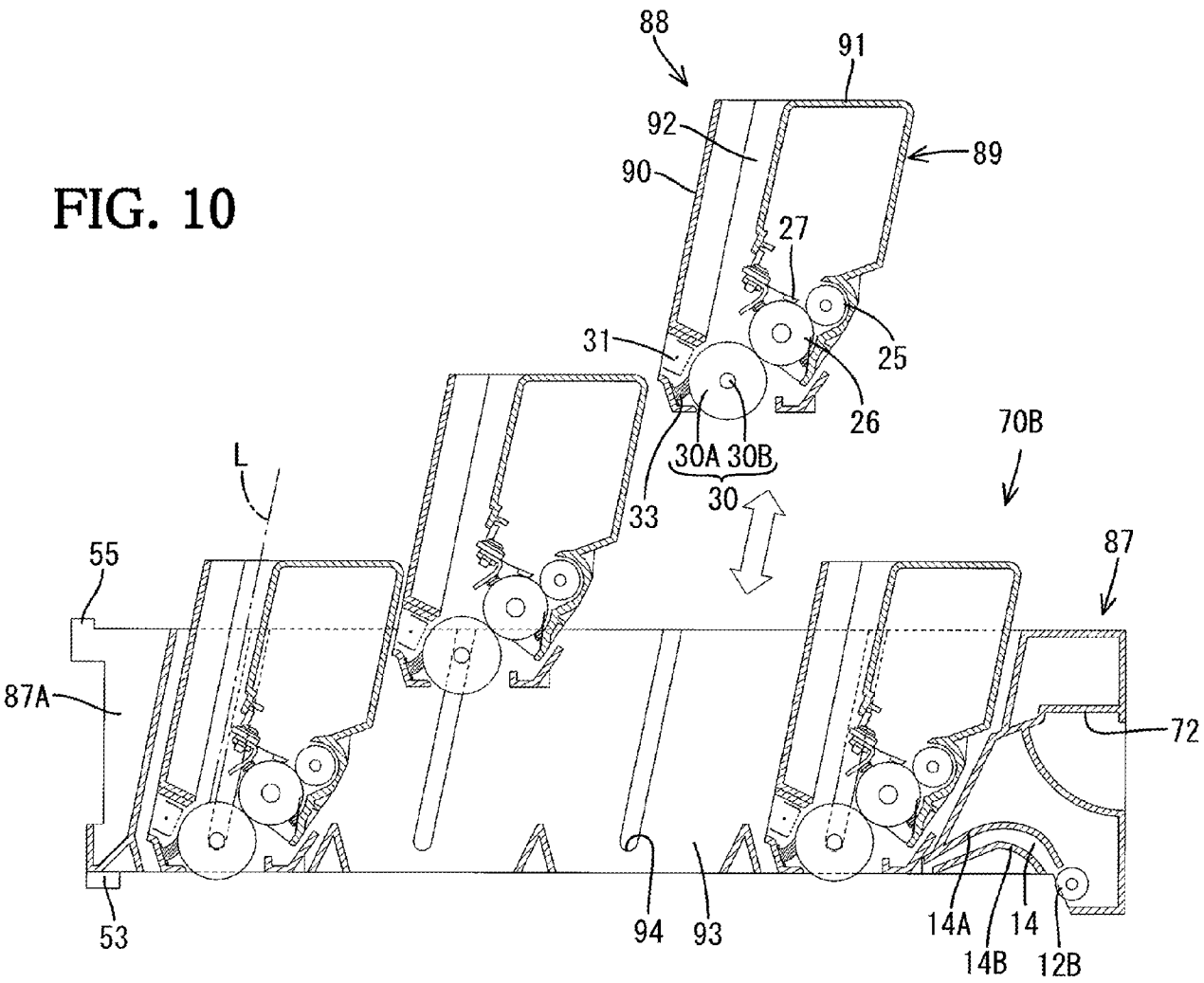
FIG. 10 is a sectional side view of another example image forming unit according to the invention.

Referring to FIG. 10, another variation of the structure of an image forming unit according to some examples of this invention will be described. In this example structure, four cartridges 88 each include a group of: (a) a developing cartridge 89, (b) a photosensitive drum 30, (c) a scorotron charger 31, and (d) a cleaning brush 33. The cartridges 88 are attachable and detachable with respect to a frame 87 of an image forming unit 70B. Hereinafter, description will be made as to one of the cartridges 88, and the reader will understand that the remaining cartridges 88 in this example have the same structure. The cartridge 88 includes a cartridge frame 90 that holds the photosensitive drum 30 at its bottom. The cartridge frame 90 further supports, at its bottom, the scorotron charger 31 and the cleaning brush 33 around the photosensitive drum 30. The developing cartridge 89 is supported in the cartridge frame 90 so as to be capable of being attached and detached with respect to the cartridge frame 90. The photosensitive drum 30 and the developing roller 26 of the developing cartridge 89 are held while being press-contacted with each other. The cartridge 88 has a slit 92 formed between a rear wall of a housing 91 of the developing cartridge 89 and the cartridge frame 90. The slit 92 is provided so as to extend from the upper end of the cartridge 88 to the upper surface of the photosensitive drum 30, and a laser beam L emitted from the scanner portion 18 passes through the slit 92 to reach the photosensitive drum 30.

In the frame 87, four cartridge mounting portions 93, to which the cartridges 88 are detachably mounted, are aligned in the front-rear direction so as to communicate with each other (e.g., the portions 93 are open with respect to one another at their tops). Both right and left sidewalls 87A of the frame 87 include guide grooves 94 with which the drum shafts 30B of the photosensitive drums 30 (or other desired structure(s) of the cartridge 88) are engaged. The guide grooves 94 extend diagonally upwardly from the lower portions of the sidewalls 87A toward the front and are open at their upper ends at the upper edges of the sidewalls 87A. During installation and removal of the cartridge 88 with respect to the frame 87, the drum shaft 30B of the photosensitive drum 30 (or other desired structure(s)) is guided along the guide grooves 94. Thus, the installation and removal of the cartridge 88 is guided. As shown, a removal direction of the cartridges 88 extends diagonally forward (toward the pulling direction of the frame 87). The installation/removal direction of the cartridges 88 (indicated by a double-headed arrow in FIG. 10) is substantially parallel to an extending direction of the slit 92 and/or at least a portion of the optical path of a laser beam L to be emitted from the scanner portion 18 along the slit 92. The term "substantially parallel," as used in this context, includes parallel.

According to this structural variation of an image forming unit 70B and/or developer cartridge 88 according to the invention, each of the cartridges 88 includes the group of: (a) the developing cartridge 89, (b) the photosensitive drum 30, (c) the scorotron charger 31, and (d) the cleaning brush 33. If desired, these parts may be replaced simultaneously with new ones, e.g., whenever a new developer cartridge 88 is supplied. Alternatively, if desired, the developing cartridge 89 may be removable from other portions of the cartridge 88 such that it can be independently replaced without replacing the drum 30, charger 31, and/or brush 33. Of course, any combination of parts may be included as a unit as part of a developing cartridge (e.g., like cartridge 88) without departing from this invention.

Figure 11:
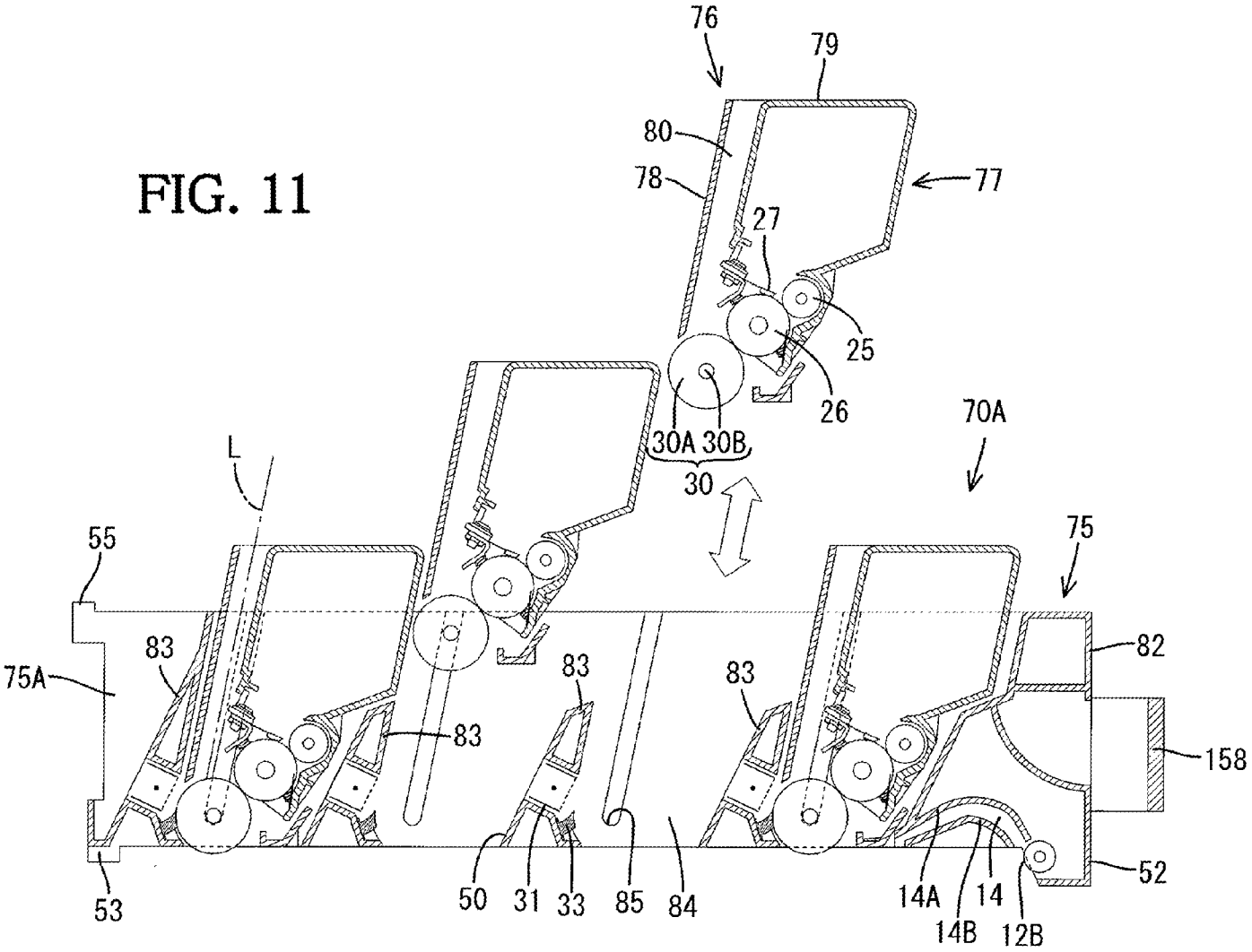
FIGS. 11 and 12 are sectional side views of additional example image forming units.
Figure 12:
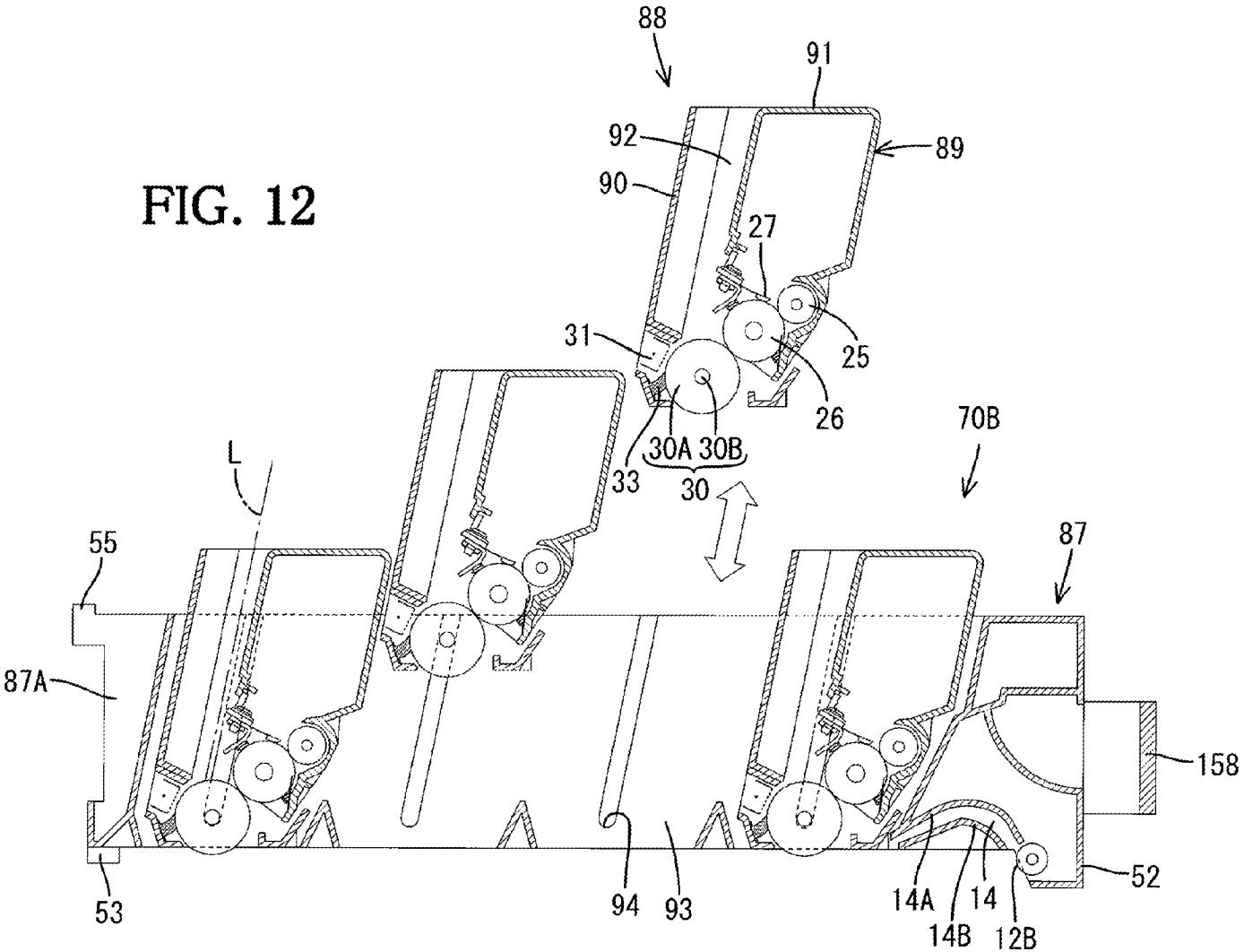

In the various example structures shown in FIGS. 9 and 10, a recessed grip portion 72 is provided at the front end of frames 75 and 87. Alternatively, as shown in FIGS. 11 and 12, image forming units 70A and 70B may be provided with a grip portion 158 that protrudes toward the front of the image forming apparatus structure from the frames 75 and 87. By holding the grip portion 158, the user can pull, push, and/or lift the image forming units 70A and 70B. With this structure, the user can easily carry the image forming unit 70A and 70B to different places once it is separated from its respective image forming device.

Figure 13:
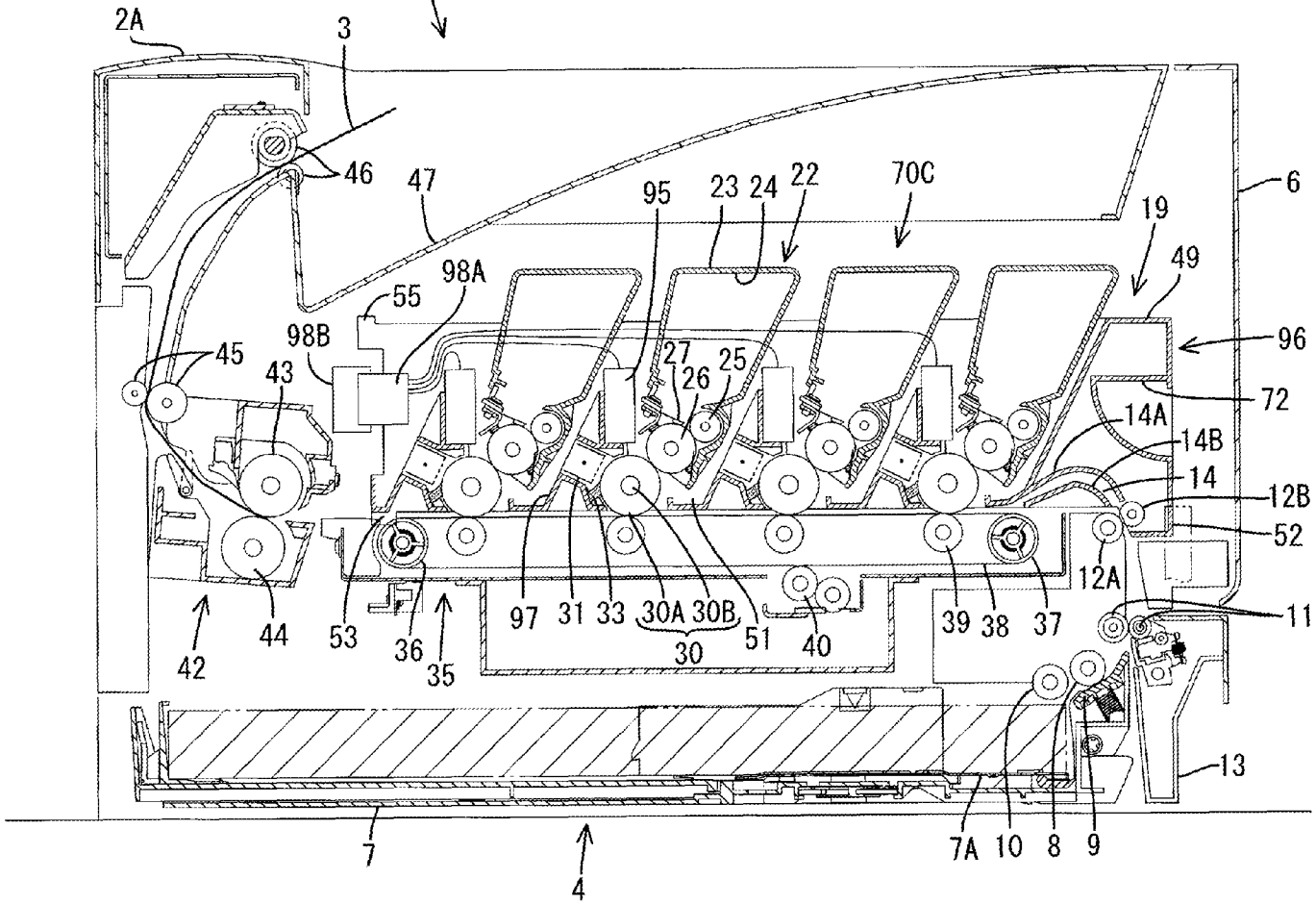
FIG. 13 is a sectional side view of an example laser printer structure according to still another example of the invention.
Figure 14:
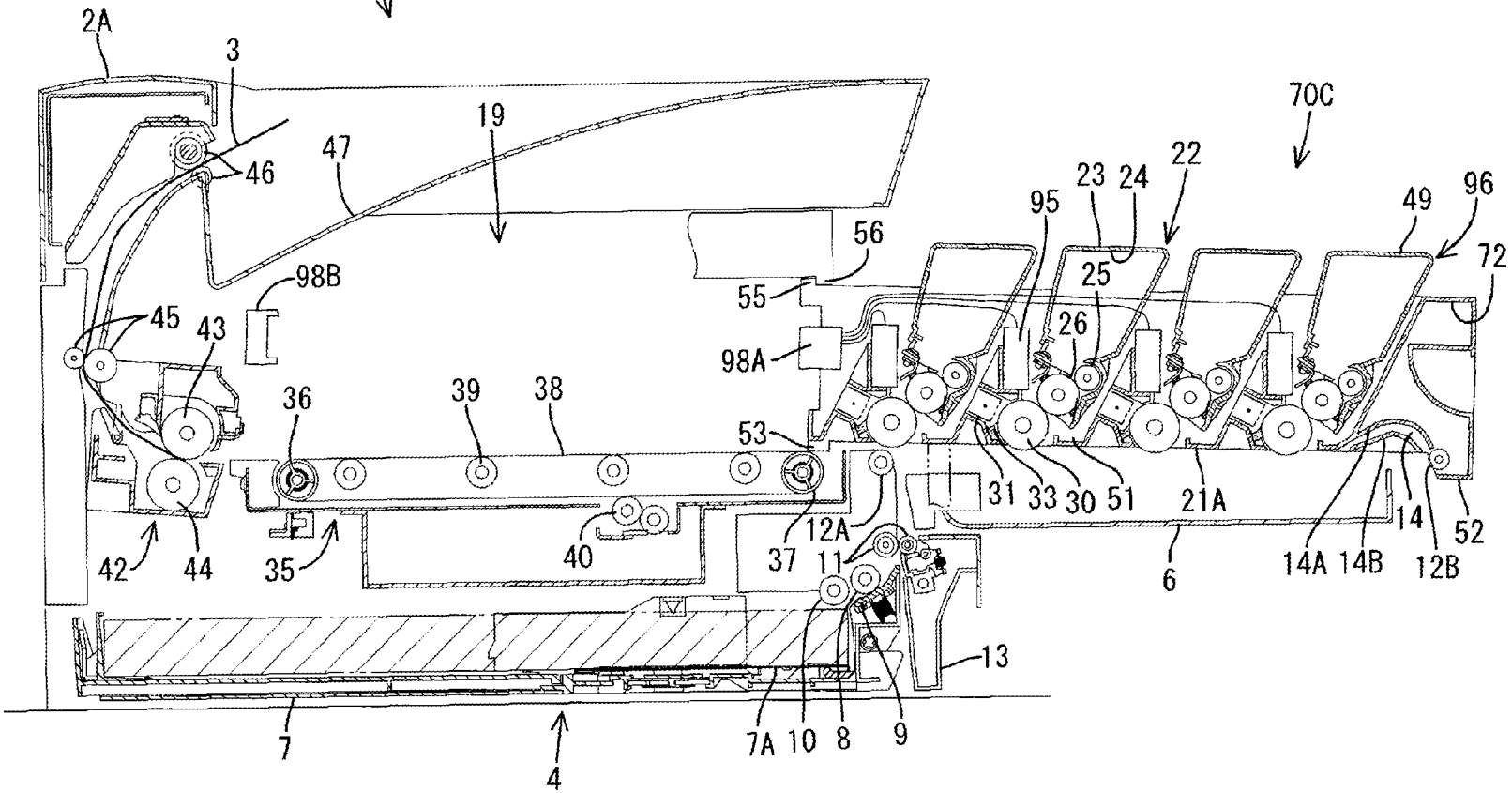
FIG. 14 is a sectional side of the example laser printer of FIG. 13 in which an example image forming unit is shown pulled from a main casing of the laser printer.

Referring to FIGS. 13 and 14, another variation of example structures according to at least some examples of this invention will be described. As shown, in this example structure, an image forming unit 70C is included having four individual LED exposure units 95, one each corresponding to the four colors of black, cyan, magenta, and yellow. These LED exposure units 95 are attached to the top of respective partition walls 97 of a frame 96 and are electrically connected to a frame-side connector 98A provided at a rear end of the frame 96. The frame-side connector 98A connects with a main-casing-side connector 98B fixed to a main casing 2A of a laser printer 1A when the frame 96 is located at the attached position. In this manner, the LED exposure units 95 are electrically connected to a control circuit (not shown) provided in the main casing 2A. When the image forming unit 70C is pulled from the attached position, the frame-side connector 98A disconnects from the main-casing-side connector 98B, as shown in FIG. 14. Each of the LED exposure units 95 of this example structure includes a plurality of light-emitting diodes (not shown) that are aligned along the axial direction of the photosensitive drum 30, and these diodes irradiate light onto the surface of the photosensitive drum 30 to form an electrostatic latent image on the surface of the photosensitive drum 30 by controlling the on/off condition of the light-emitting diodes based on image data corresponding to each respective color.

In this example structure, the image forming unit 70C includes LED exposure units 95 therein, and therefore, a separate exposure device can be omitted from the main casing 2A. Thus, the structure of the main casing 2A of the laser printer 1A can be simplified.

Figure 15:
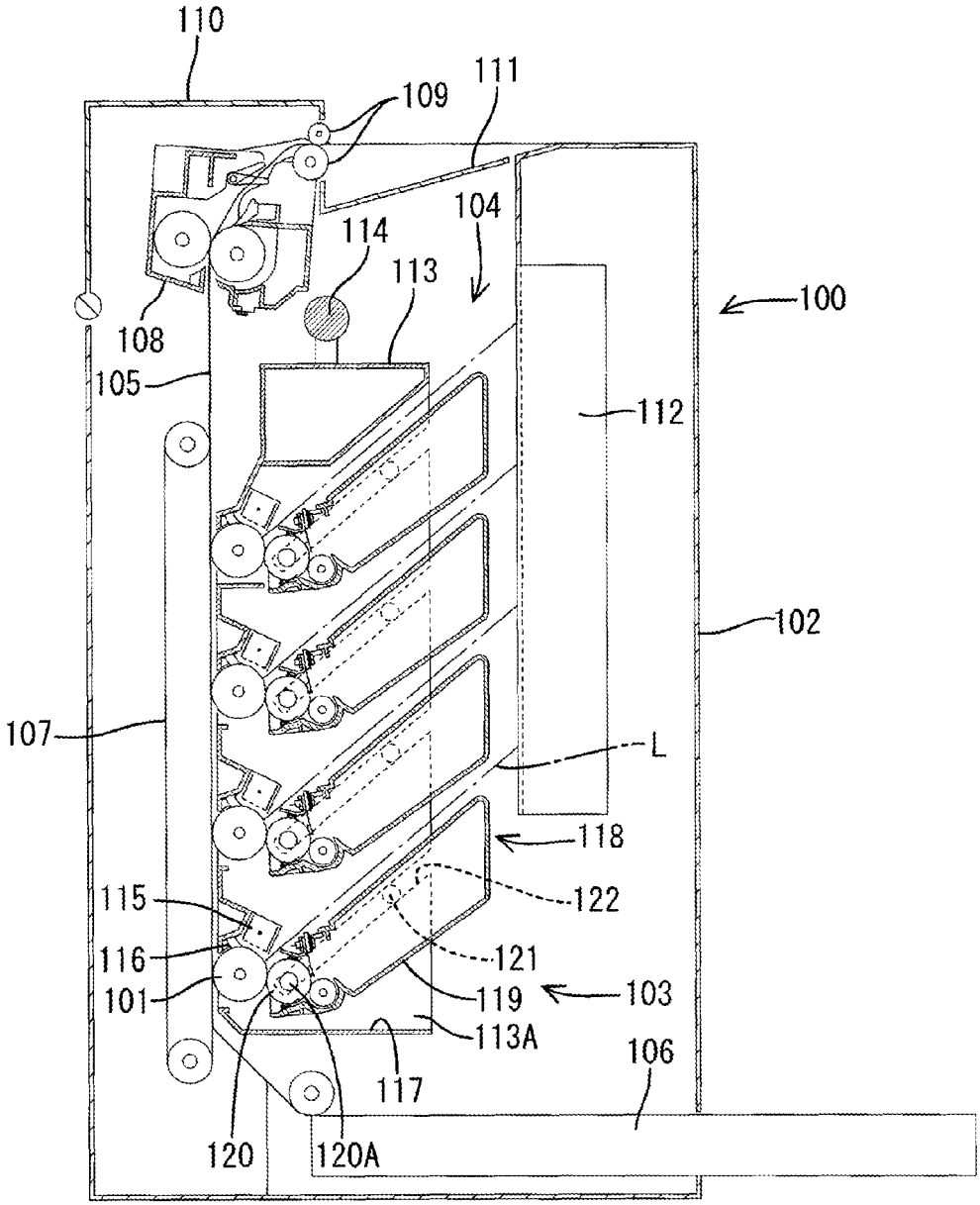
FIG. 15 is a side view showing a schematic structure of an example laser printer structure according to another example of this invention.
Figure 16:
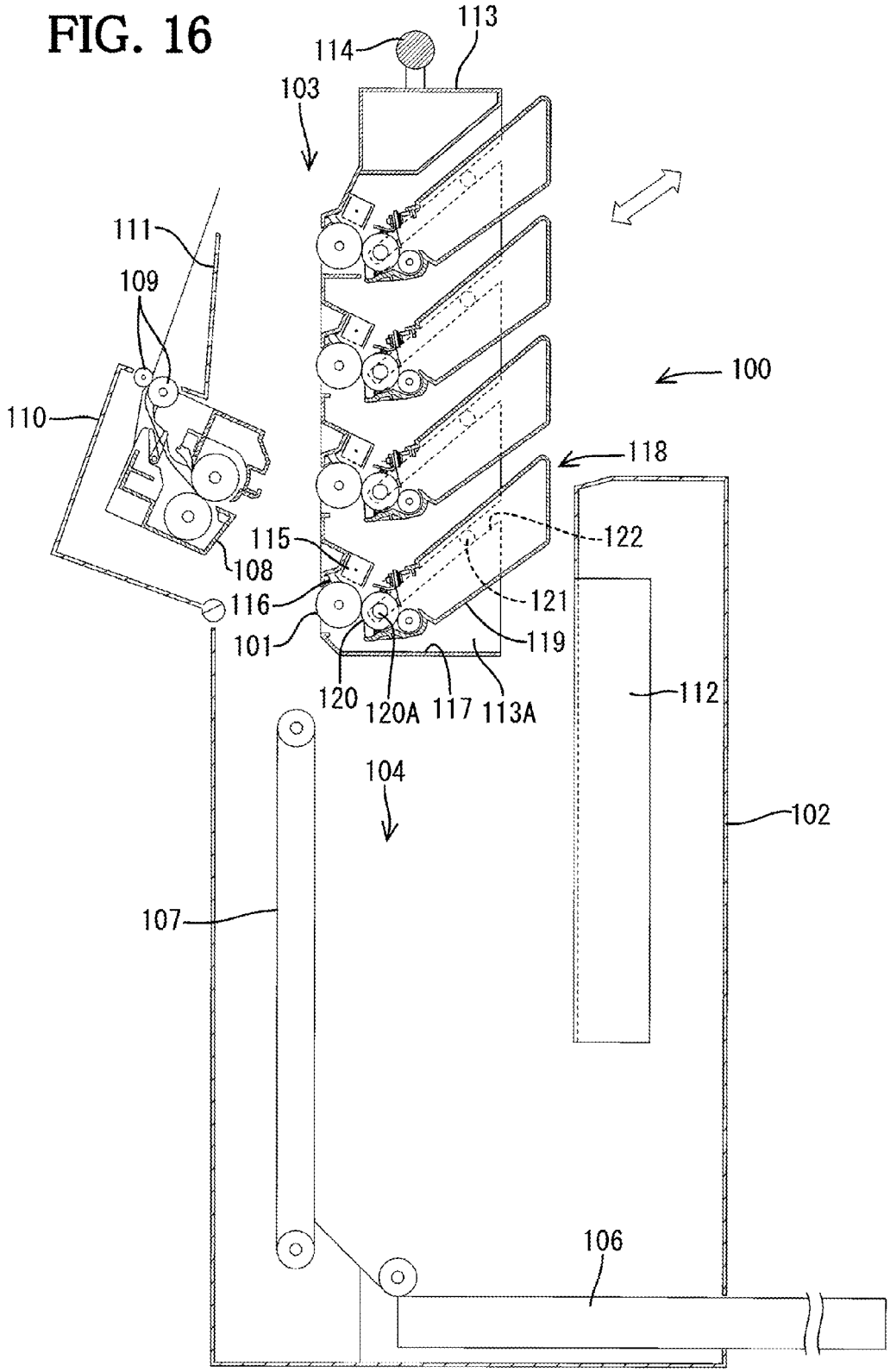
FIG. 16 a sectional side of the example laser printer of FIG. 15 in which an image forming unit is shown pulled from a main casing of the laser printer.

Referring to FIGS. 15 and 16, another image forming apparatus structure 100 according to at least some examples of this invention will be described below. In the following description, the right in FIG. 15 will be referred to as the front side of a laser printer 100, the left in FIG. 15 will be referred to as the back or rear of the laser printer 100, and the far side and the near side in FIG. 15 will be referred to as the right and the left of the laser printer 100, respectively. An image forming procedure to be implemented in the laser printer 100 of this example structure may be similar to the procedures implemented in the laser printer 1 of the first example structure described above, and therefore, a detailed description of this the procedure will be omitted.

As shown in FIG. 15, the laser printer 100 of this example structure is a so-called "direct-tandem-type" color laser printer that includes four photosensitive drums 101 corresponding to the four colors of black, cyan, magenta, and yellow. In this example structure, a toner image formed on each of the photosensitive drums 101 is directly transferred onto a recording medium, such as a piece of paper or other sheet or recording media.

The laser printer 100 of this example structure includes a vertically elongated main casing 102. Inside the main casing 102, a unit accommodating portion 104, into which an image forming unit 103 is to be mounted, is provided. A sheet supply tray 106, in which sheets 105 as recording media are loaded, is provided at the bottom of the main casing 102. A sheet 105 from the sheet supply tray 106 is supplied to a transfer belt 107. The transfer belt 107 is provided at the rear of the unit accommodating portion 104 so as to extend substantially in the vertical direction. The transfer belt 107 conveys a sheet 105, which is adhered to the surface of the transfer belt 107 by static electricity, to a fixing part 108 disposed at an upper portion in the main casing 102. Inside the endless transfer belt 107, transfer rollers (not shown) are provided so as to be opposite to the corresponding photosensitive drums 101 of the image forming unit 103. The sheet 105, which has passed through the fixing part 108, is then conveyed to a pair of discharge rollers 109. An upper cover 110 is provided at the top of the main casing 102. The upper cover 110 is capable of opening and closing with respect to the main casing 102, e.g., as shown in FIG. 16. The upper cover 110 of this example structure 100 integrally holds the fixing part 108 and the discharge rollers 109 in its interior. A sheet discharge tray 111, which holds sheets 105 discharged by the discharge rollers 109, is provided at the top of laser printer 100 so as to extend from the upper surface of the upper cover 110 to the upper surface of the main casing 102. Inside the main casing 102, a scanner portion 112 (functioning as the exposure device) is provided at the front of the unit accommodating portion 104. The scanner portion 112 diagonally downwardly emits four laser beams L, one beam each corresponding to the four colors of black, cyan, magenta, and yellow, from its rear side. Portions of the optical paths of the laser beams L for this example structure 100 are indicated by dot and dashed lines in FIG. 15. The laser beams L in this example structure 100 are emitted from the scanner portion 112 and may follow paths at least partially in parallel with each other and spaced at regular intervals in the top-down direction.

The image forming unit 103 of this example structure is capable of being pulled upward and attached and detached with respect to the main casing 102. Between the image forming unit 103 and the main casing 102, a guiding device (not shown) and a locking device (not shown) may be provided. Any desired types of guiding devices and/or locking devices may be used without departing from the invention. The guiding device (e.g., including rails and/or guide grooves, etc.) may be used to guide the pulling operation of the image forming unit 103. The locking device may be used to maintain the image forming unit 103 at the pull-stop position (e.g., at or near the position shown in FIG. 16). The image forming unit 103 of this illustrated example structure 100 includes a vertically elongated frame 113 having a substantially box shape. A grip portion 114 is provided at a top of the image forming unit 103. The user holds the grip portion 114 when pulling and lifting the image forming unit 103 to move the image forming unit 103 away from the image forming position. The frame 113 includes the four photosensitive drums 101 arranged at regular intervals in the top-down direction at the rear of the frame 113. The frame 113 further may include scorotron chargers 115 and cleaning brushes 116, which may be disposed around the corresponding photosensitive drums 101 in any desired manner, including the various manners generally described above.

In the frame 113, a cartridge mounting portion 117 having an open front end is opened is provided at the front of the photosensitive drums 101. Four developing cartridges 118, corresponding to the four colors of cyan, magenta, yellow, and black, are attached to the cartridge mounting portion 117 of the frame 113 so as to be aligned in the vertical direction at a distance from each other. Each of the developing cartridges 118 includes a housing 119 and a developing roller 120 having a roller shaft 120A at a rear end portion of the housing 119. The ends of the roller shaft 120A of the developing roller 120 protrude from the right and left sides of the housing 119. A guiding pin 121 is provided with the housing 119 so as to protrude from right and left outer surfaces of the housing 119 at a diagonally-upper-front position with respect to the roller shaft 120A. The frame 113 also may be provided with guide grooves 122 at its right and left sidewalls 113A. The roller shaft 120A of the developing roller 120 and the guiding pins 121 of the developing cartridge 118 may be engaged with the guide grooves 122. The guide grooves 122 extend diagonally upwardly toward the front from the rear portion of the sidewalls 113A and their front ends are opened at the front edge of the sidewalls 113A. By engaging the roller shaft 120A and the guiding pins 121 with the guide grooves 122, the posture of the developing cartridge 118 is settled, and by moving the roller shaft 120A and the guiding pins 121 along the guide grooves 122, installation and removal of the developing cartridge 118 is guided. As shown, a removal direction of the cartridges 118 from the frame 113 in this illustrated example structure extends diagonally forward (and toward the pulling direction of the frame 113). The installation/removal direction of the developing cartridges 118 (indicated by a double-headed arrow in FIG. 16) also is substantially parallel to at least a portion of the optical path of a laser beam L to be emitted from the scanner portion 112 (the term "substantially parallel," as used in this context, includes parallel). In addition, upper and lower surfaces of the housing 119 of each developing cartridge 118 extend substantially in parallel with the optical path of the laser beam L (the term "substantially parallel," as used in this context, includes parallel), e.g., so as to create slits or channels through which the laser beams L can pass.

To pull the image forming unit 103 from the attached position shown in FIG. 15, first, the user opens the upper cover 110 and pulls the image forming unit 103 accommodated in the unit accommodating portion 104 by holding the grip portion 114 (see FIG. 16). When the image forming unit 103 reaches the pull-stop position, the frame 113 may be maintained at this position by a locking device (e.g., spring-loaded retaining elements that snap into place when the image forming unit 103 moves to a predetermined position), so that replacement of the developing cartridges 118 can be performed. In this state, the developing cartridges 118 may be detached from the frame 113 by pulling the developing cartridges 118 diagonally upward and forward (generally toward the pulling direction of the image forming unit 103), and the developing cartridges 118 may be attached to the frame 113 by pushing the developing cartridges 118 diagonally downward and rearward. With this structure, operability is high when replacing developing cartridges as compared with a case where developing cartridges are attached and detached with respect a frame in a horizontal direction.

To separate the image forming unit 103 from the main casing 102, the user releases the locking device (if necessary) and lifts the image forming unit 103, e.g., by holding the grip portion 114. As described above, the grip portion 114 to be held when the image forming unit 103 is lifted is provided so that the user can easily carry the image forming unit 103 separately. As described above, the removal direction of the developing cartridges 118 extends diagonally upward when the image forming unit 103 is pulled from the main casing 102 and lifted. Therefore, even if a shock or impact is made on the frame 113 during frame 113 pulling, removal, or carrying operations, the developing cartridges 118 typically will not accidentally fall from the frame 113. Furthermore, as also noted above, at least some portions of the optical paths of the laser beams L in at least some example structures extend substantially in parallel with the installation/removal direction of the developing cartridges 118 (which includes parallel), so that developing cartridges 118 having a large or maximum capacity can be provided. The image forming unit 103 can be readily attached to and detached from the main casing 102, so that by removing the image forming unit 103 from the main casing 102, clearance of a paper jam, repair, and/or part replacement can be easily performed in the main casing 102.

Figure 17:
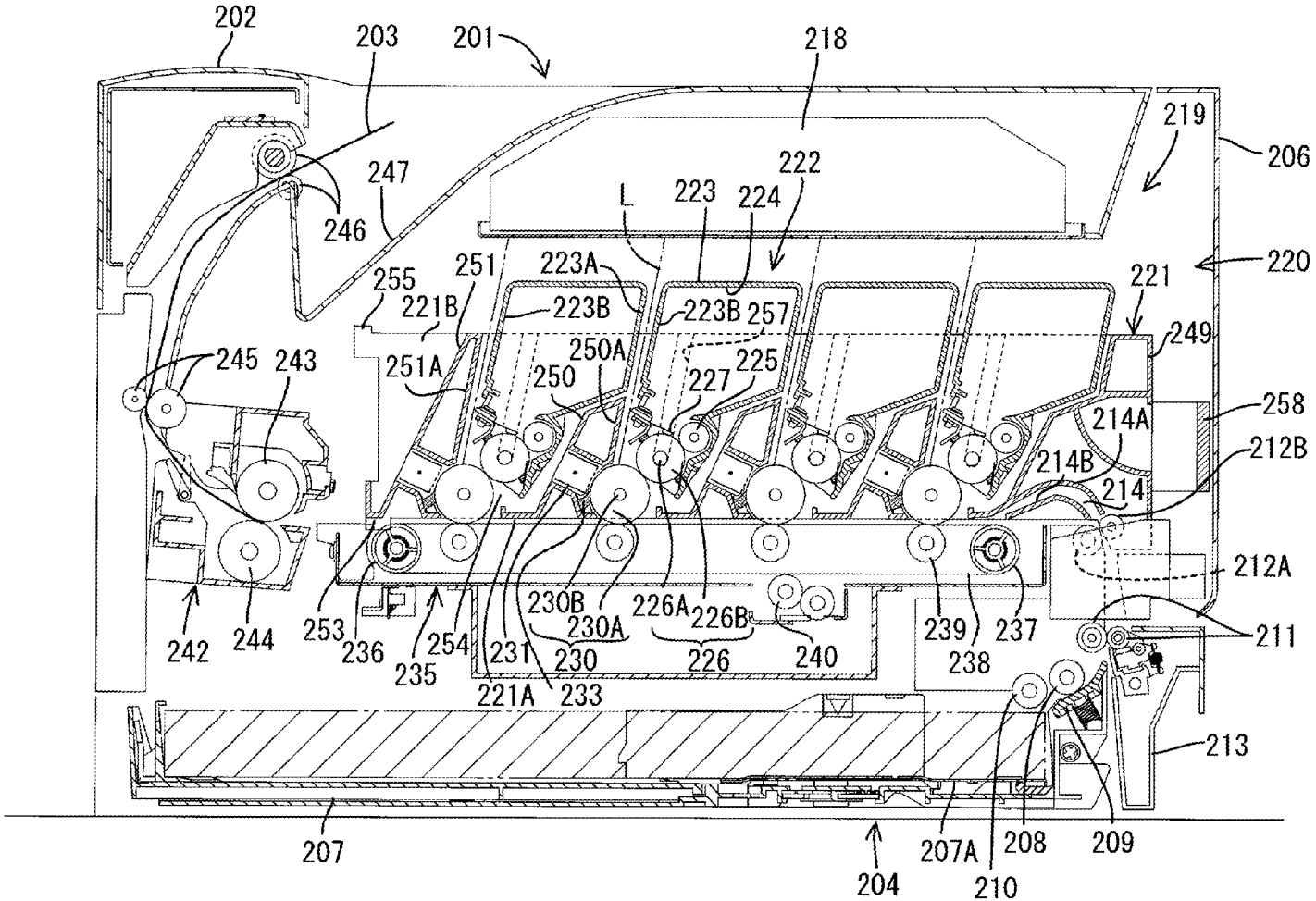
FIG. 17 is a sectional side view showing a schematic structure of an example laser printer structure according to still another example of this invention.
Figure 18:
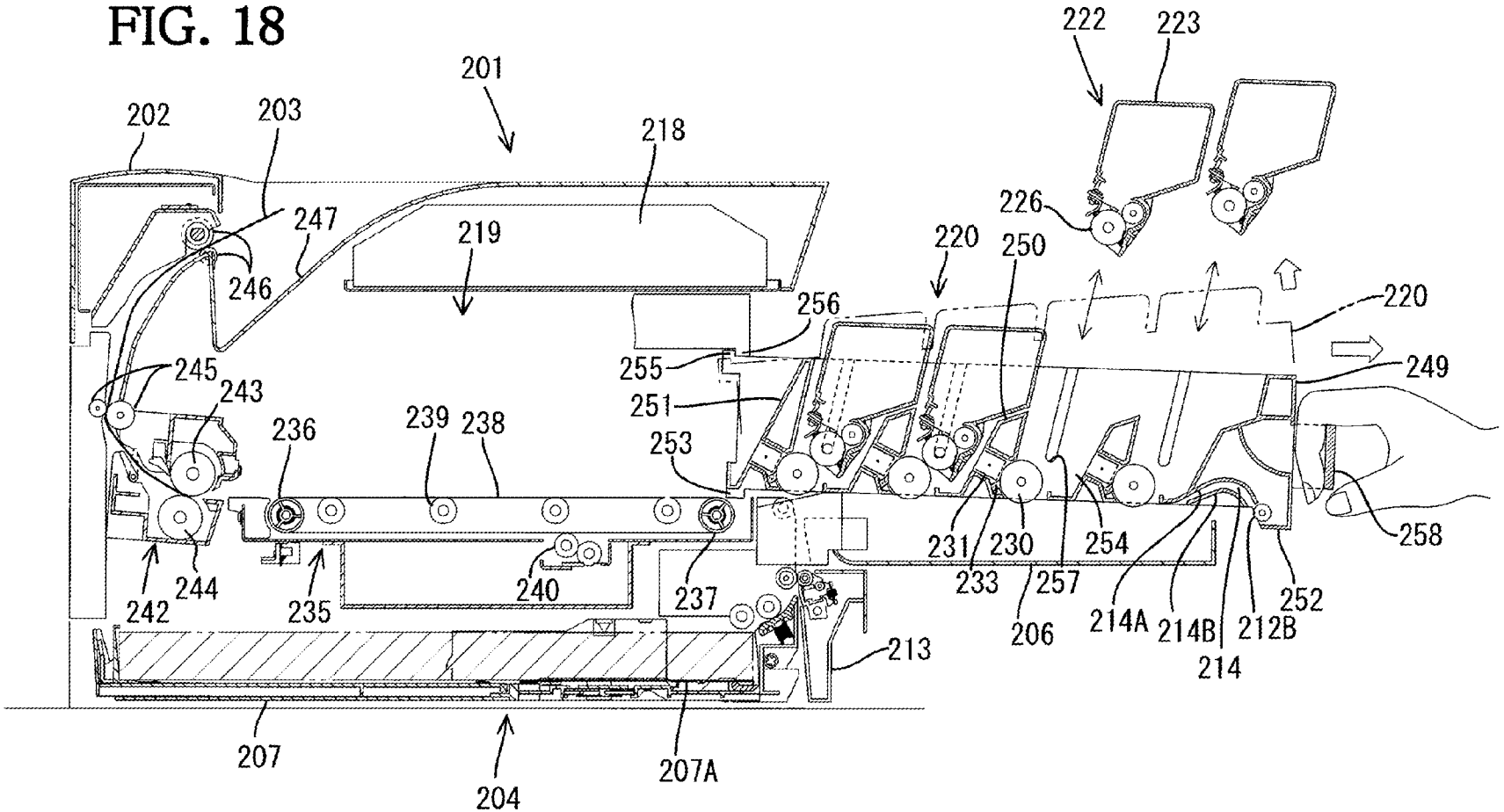
FIG. 18 is a sectional side view of the laser printer of FIG. 17 in which an image forming unit is shown pulled from a main casing of the laser printer.

Referring now to FIGS. 17 and 18, another example image forming device structure according to the invention will be described. As shown in FIG. 17, this example laser printer 201 is a so-called "direct-tandem-type" color laser printer that includes four photosensitive drums 230 corresponding to the four colors of black, cyan, magenta, and yellow. In this example structure 201, a toner image formed on each of the respective photosensitive drums 230 is directly transferred onto a recording medium, such as a sheet of paper. The laser printer 201 of this example structure includes, in a main casing 202, a sheet feeding part 204 that supplies sheets 203 as one type of recording media, an image forming unit 220 that forms an image on a sheet 203 supplied therein, and a sheet conveying part 235 that conveys a sheet 203 with respect to the image forming unit 220. In the following description, the right in FIG. 17 will be referred to as the front side of the laser printer 1, the left in FIG. 17 will be referred to as the back or rear of the laser printer 201, and the far side and the near side in FIG. 17 will be referred to as the right and the left of the laser printer 201, respectively.

The front of the main casing 202 in this example structure 201 is provided with a front cover 206, which is capable of opening and closing with respect to the main casing 202. This front cover 206 is capable of pivoting between a covering position (see FIG. 17) and an uncovering position (see FIG. 18) about an axis (e.g., shaft(s), hinge(s), etc.) located at its lower end (although other cover and opening configurations may be used without departing from this invention). At the covering position, as shown in FIG. 17, the front cover 206 extends in a substantially upright position to cover the front of the main casing 202. At the uncovering position, as shown in FIG. 18, the front cover 206 rotates downward to extend to a substantially horizontal position. By pivoting the front cover 206 toward the front from the covering position, the front cover 206 may be moved to the uncovering position. When the front cover 206 is located at the uncovering position, the image forming unit 220 can be pulled toward the front from the main casing 202. When the front cover 206 of this example structure is located at the covering position, a surface of an upper end of the front cover 206 extends substantially in the same plane as a top surface of the main casing 202 (other arrangements are possible, of course, without departing from this invention).

The sheet feeding part 204 includes, at a bottom portion in the main casing 202, a sheet supply tray 207, a sheet supply roller 208, a separating pad 209, a pickup roller 210, a pair of paper dust removing rollers 211, and a pair of register rollers 212A and 212B. The sheet supply tray 207 is attachable to and detachable from the bottom portion of the main casing 202. The sheet supply roller 208 and the separating pad 209 are provided at an upper portion of a front end portion of the sheet supply tray 207. The pickup roller 210 is provided at the rear of the sheet supply roller 208. The paper dust removing rollers 211 are disposed at an upper front side of the sheet supply roller 208. The register rollers 212A and 212B are disposed above the pair of paper dust removing rollers 211.

The sheet supply tray 207 of this example structure has a thin plate shape onto which sheets 203 may be loaded in layers. The sheet supply tray 207 also includes a front wall 213 at its front end. The front wall 213 is located under the front cover 206 when the sheet supply tray 207 is attached to the main casing 202. By pulling the front wall 213 of the sheet supply tray 207 toward the front, the sheet supply tray 207 can be horizontally drawn toward the front of the main casing 202. Inside and at the bottom of the sheet supply tray 207, a sheet pressing plate 207A is provided. The sheet pressing plate 207A is capable of holding layers of sheets 203. The sheet pressing plate 207A is pivotably supported at its rear end while its front end is upwardly urged by a spring (not shown). With this structure, sheets 203 stacked in the sheet supply tray 207 are held by the sheet pressing plate 207A with their front ends being upwardly urged.

An uppermost sheet 203 of the stack of sheets 203 loaded in the sheet supply tray 207 is pressed toward the pickup roller 210 by an urging force from the sheet pressing plate 207A. Upon rotation of the pickup roller 210, the uppermost sheet 203 is conveyed toward and between the sheet supply roller 208 and the separating pad 209. Then, when the sheet 203 is sandwiched between the sheet supply roller 208 and the separating pad 209, the topmost sheet 203 is separated from the stack of sheets 203 and supplied, one by one, by rotation of the sheet supply roller 208. The separated sheet 203 then passes the pair of paper dust removing rollers 211 so that paper dust adhering to the sheet 203 is removed therefrom. After that, the sheet 203 is further conveyed to the pair of register rollers 212A and 212B.

The register rollers 212A and 212B function as a drive roller and a following roller, respectively. The register rollers 212A and 212B correct skewing of the sheet 203, if necessary, and convey the sheet 203 onto a transfer belt (a sheet conveyor belt) 238 of the sheet conveying part 235 via a sheet supply path 214. The sheet supply path 214 of this example structure 200 is an arc-shaped sheet conveying path that is at least partially formed in a frame 221 of the image forming unit 220.

At a top portion in the main casing 202 of this example printer structure 201, a scanner portion 218 (functioning as an exposure device) is provided. The scanner portion 218 emits one or more laser beams L, based on predetermined image data, by color of toner, onto each surface of each photosensitive drum 230 (e.g., at high-speed scanning speeds). That is, the four laser beams L corresponding to the respective colors are emitted diagonally downwardly from a bottom of the scanner portion 218. Portions of the optical paths of the laser beams L in this example structure 201 are indicated by dot and dashed lines in FIG. 17. The laser beams L are emitted from the scanner portion 218 in this example structure 201 substantially in parallel with each other (at least as they approach the photosensitive drums 230) and/or are spaced at regular intervals in a front-rear direction (the term "substantially in parallel," in this context, includes parallel).

Inside the main casing 202, a unit accommodating portion 219 is provided below the scanner portion 218. The image forming unit 220, which can be pulled toward the front and can be attached to and separated from the main casing 202, is accommodated in the unit accommodating portion 219. The image forming unit 220 in this example structure 201 includes a frame 221. The frame 221 supports four sets (or groups) of process devices, each of which in this example structure 201 includes a photosensitive drum 230 (functioning as the image carrying member), a scorotron charger 231 (functioning as the charging device), a developing cartridge 222 (functioning as the developing device), and a cleaning brush 233. These process devices are arranged substantially in parallel with each other in the front-rear direction (i.e., in the pulling direction of the image forming unit 220).

The four developing cartridges 222 are independently attachable to and detachable from the frame 221 of the image forming unit 220 and are provided corresponding to the respective colors of black, cyan, magenta, and yellow. Hereinafter, description will be made of one of the developing cartridges 222, and the reader will understand that all the remaining developing cartridges 222, at least in this example, have the same structure. The developing cartridge 222 includes a box-shaped housing 223 with an open bottom structure. The housing 223 has a toner storage chamber 224, which may be filled with toner, at its upper portion. An agitator (not shown) may be provided in the toner storage chamber 224. When the agitator rotates upon input of power from a motor (not shown), toner stored in the toner storage chamber 224 is agitated. The developing cartridge 222 further may include a toner supply roller 225, a developing roller 226, and a layer-thickness regulating blade 227 under the toner storage chamber 224.

The toner supply roller 225 in this example structure 201 is rotatably supported by the housing 223 of the developing cartridge 222 and includes a metal roller shaft covered with a roller portion made of conductive foam material. The toner supply roller 225 is rotated by input of power from a motor (not shown).

The developing roller 226 of this example structure 201 is disposed at a diagonally-lower-rear position with respect to the toner supply roller 225, in such a manner as to contact the toner supply roller 225 while being press-deformed together with it. The developing roller 226 opposingly contacts the photosensitive drum 230 when the developing cartridge 222 is attached to the frame 221. The developing roller 226 of this example includes a metal roller shaft 226A covered with a roller portion 226B made of conductive urethane rubber or conductive silicone rubber, which may include, for example, carbon particles. A surface of the roller portion of the developing roller 226 is coated with a layer made of urethane rubber or silicone rubber, which may include fluorine. During developing, a developing bias may be applied to the developing roller 226, and the developing roller 226 may be rotated by input of power from a motor (not shown).

The layer-thickness regulating blade 227 in the illustrated example structure 201 includes a blade body, e.g., made of a metal plate spring member, and a pressing portion having a generally semicircular shape in cross section. The pressing portion is provided at a free end of the blade body and is made of insulative silicone rubber. The layer-thickness regulating blade 227 is supported by the housing 223 above the developing roller 226 and is pressed against the developing roller 226 by elastic force of the blade body.

Toner discharged from the toner storage chamber 224 is supplied to the developing roller 226 by rotation of the toner supply roller 225, and the toner may be positively charged by friction created between the toner supply roller 225 and the developing roller 226. The toner supplied onto the developing roller 226 then goes between the pressing portion of the layer-thickness regulating blade 227 and the developing roller 226. Through use of the layer-thickness regulating blade 227 along with the rotation of the developing roller 226, the toner may be uniformly regulated to a specified thickness as a thin layer and carried on the developing roller 226.

The photosensitive drum 230 in this illustrated example structure 201 includes a drum body 230A having a cylindrical shape and a metallic drum shaft 230B. The drum body 230A may be formed such that its outermost layer is a positively charged photosensitive layer made of, for example, polycarbonate. The drum shaft 230B is provided at a central axis of the drum body 230A and extends in a longitudinal direction of the drum body 230A. The drum shaft 230B may be supported by the frame 221, and the drum body 230A is rotatably supported by the drum shaft 230B. With this structure, the photosensitive drum 230 is provided so as to rotate about the drum shaft 230B in the frame 221. The photosensitive drum 230 may be rotated by input of power from a motor (not shown).

A scorotron charger 231 is disposed facing the photosensitive drum 230 in this example structure 201, e.g., at a specified distance so as not to contact the photosensitive drum 230. The scorotron charger 230 may be located at any desired position, such as at a diagonally-upper-rear position with respect to the photosensitive drum 230 in this example structure 201. The scorotron charger 231 uniformly charges the surface of the photosensitive drum 230, e.g., by generating a corona discharge from a discharge wire, such as a tungsten wire.

The cleaning brush 233, when present, may be disposed so as to opposingly contact the photosensitive drum 230, e.g., from the rear.

In this example laser printer structure 201, the sheet conveying part 235 is disposed so as to be located under the image forming unit 220 when the image forming unit 220 is accommodated in the unit accommodating portion 219. The sheet conveying part 235 of this example structure 201 includes a pair of belt support rollers 236 and 237 and the transfer belt 238. The belt support rollers 236 and 237 are spaced from one another in the front-rear direction and extend in parallel with each other. The transfer belt 238 is disposed so as to run between the pair of belt support rollers 236 and 237. Upon rotation of the rear belt support roller 236 by power from a motor, the transfer belt 238 moves in a circle around the belt support rollers 236 and 237. Inside the endless transfer belt 238, four transfer rollers 239 are arranged, e.g., at regular intervals in the front-rear direction, so as to be opposite to the corresponding photosensitive drums 230 of the image forming unit 220 with the transfer belt 238 sandwiched between the photosensitive drums 230 and their corresponding transfer rollers 239. Under the transfer belt 238, a cleaning roller 240 is provided to remove residual toner adhered to the transfer belt 238. The sheet 203 discharged from the pair of register rollers 212A and 212B passes through the sheet supply path 214 and then contacts a vicinity of an upper front end of the transfer belt 238. The sheet 203 may be adhered to the upper surface of the transfer belt 238, e.g., by static electricity, and is conveyed toward the rear (in a lateral direction) of the printer structure 201 by circulation of the transfer belt 238.

The surface of the photosensitive drum 230 may be uniformly positively charged by the scorotron charger 231 and rotation of the photosensitive drum 230, and then, the drum 230 may be exposed to a laser beam L emitted from the scanner portion 218 at high speed scanning. In this manner, an electrostatic latent image corresponding to an image to be formed onto the sheet 203 may be formed onto the surface of the photosensitive drum 230.

With the rotation of the developing roller 226, toner carried on the developing roller 226 and positively charged makes contact with the photosensitive drum 230 and is supplied to develop the electrostatic latent image formed on the surface of the photosensitive drum 230. The toner is supplied to an exposed portion of the (formerly) uniformly positively charged surface of the photosensitive drum 230, and it remains at portions of the drum 230 where the potential has become lowered due to the exposure to the laser beam L. As a result, the electrostatic latent image on the photosensitive drum 230 becomes visible and a reversal phenomenon occurs. In this manner, a toner image is formed on the surface of the photosensitive drum 230.

The toner image carried on the photosensitive drum 230 in this example printer structure 201 according to the invention is transferred onto a sheet 203 by a transfer bias applied to the transfer roller 239 while the sheet 203 passes through a transfer position between the photosensitive drum 230 and the transfer roller 239. The sheet 203 onto which the toner image has been transferred then is conveyed to a fixing part 242.

The fixing part 242 in this example printer structure 201 is provided at the rear of the sheet conveying part 235 in the main casing 202, and it includes a heat roller 243 and a pressure roller 244, which are opposite to each other. At the fixing part 242, toner transferred onto the sheet 203 is fixed thereon by heat. The sheet 203 on which the toner is fixed is then conveyed by a pair of conveyor rollers 245 to a pair of discharge rollers 246 provided at an upper position of the main casing 202. The conveyor rollers 245 are disposed at a diagonally-upper-rear position with respect to the fixing part 242. The main casing 202 of this example structure 201 is provided with a sheet discharge tray 247 at its top. The sheet discharge tray 247 includes a substantially horizontal portion at its front side and a downwardly inclined portion at its rear side. The inclined portion of the sheet discharge tray 247 is downwardly inclined toward the rear. Sheets 203 discharged by the discharge rollers 246 are stacked on the sheet discharge tray 247.

Next, the structure of the image forming unit 220 according to this example of the invention will be described in more detail. As shown in FIG. 17, the frame 221 of the image forming unit 220 has a narrow box shape elongated in the front-rear direction. The frame 221 includes a front wall 249 at its front end. In the frame 221, four partition walls 250 and 251 are arranged behind the front wall 249 at regular intervals in the front-rear direction. Between each of the opposing partition walls 250 and 251 and between the front wall 249 and the partition wall 250 opposite to the front wall 249, cartridge mounting portions 254 are provided in the frame 221. The cartridge mounting portions 254 are upwardly opened and the developing cartridges 222 can be attached to and detached from the respective cartridge mounting portions 254. The front three partition walls 250 are about two-thirds the height of the frame 221. Therefore, the adjacent cartridge mounting portions 254 provided on both sides of the partition walls 250 are open to and/or communicate with each other at their upper portions. A front surface 250A of each of the partition walls 250 and a front surface 251A of the partition wall 251 are slightly inclined such that their upper ends are tilted toward the front. The inclined angle of the front surfaces 250A and 251A is set such that the front surfaces 250A and 251A extend substantially in parallel with at least a portion of the optical paths of laser beams L to be emitted from the scanner portion 218 (the term "substantially in parallel," as used in this context, includes parallel).

The photosensitive drum 230 is held at the bottom of each cartridge mounting portion 254 so that the photosensitive drum 230 is located near the partition wall 250 and/or 251 disposed at the rear of each photosensitive drum 230 when each of the developing cartridges 222 is mounted to the frame 221. Lower portions of the photosensitive drums 230 in this example structure 201 slightly protrude downward from a bottom surface 221A of the frame 221. The photosensitive drums 230 are disposed so as to be opposite to the corresponding transfer rollers 239 while sandwiching the transfer belt 238 therebetween. Inside each of the partition walls 250 and 251 in this example structure 201, the scorotron charger 231 and the cleaning brush 233 are provided around the photosensitive drum 230 at the lower portion of the partition wall 250 and 251.

The housings 223 of the developing cartridges 222 in this example printer structure 201 are identical in shape with one another. In view of the shape of the cartridge mounting portions 254, the housings 223 in this example structure have upper portions that are wider than their lower portions in the front-rear direction. When the developing cartridges 222 are mounted on the frame 221, the top portions of the housings 223 protrude upward, e.g., by a predetermined height, from the top of the frame 221. In addition, front surfaces 223A of the housings 223 extend substantially in parallel with front surfaces 250A of the corresponding partition walls 250 and 251 (the term "substantially in parallel," as used in this context, includes parallel). The rear three developing cartridges 222 are mounted on the respective cartridge mounting portions 254 such that the housings 223 of the developing cartridges 222 are situated with their front surfaces 223A extending in the same line as the front surfaces of 250A of the partition wall 250. Each of the housings 223 has a rear surface 223B that extends substantially in parallel with its front surface 223A (and substantially in parallel with at least a portion of the optical path of a laser beam L) (the term "substantially in parallel," as used in these contexts, includes parallel). The housings 223 are situated in the frame 221 in this example structure such that their rear surfaces 223B face the front surfaces 223A of the opposing housings 223 or the front surface 251A of the partition wall 251 at a predetermined distance. The laser beams L emitted from the scanner portion 218 pass through a slit clearance provided between each of the rear surfaces 223B and the front surfaces 223A of the opposing adjacent housings 223 or between the rear surface 223B of the housing 223 of the rearmost developing cartridge 222 and the front surface 251A of the partition wall 251. The laser beams L then reach the surfaces of the corresponding photosensitive drums 230.

Both right and left sidewalls 221B of the frame 221 are provided with guide grooves 257 with which end portions of the roller shafts 226A of the developing rollers 226 are engaged. The guide grooves 257 extend diagonally upwardly from the lower portions of the sidewalls 221B toward the front, and their upper ends are opened at the upper edges of the sidewalls 221B. During installation and removal of the developing cartridge 222 with respect to the frame 221, the roller shaft 226A of the developing roller 226 is guided along the guide grooves 257. Thus, the installation and removal of the developing cartridge 222 is guided. Additionally, in this example structure, the removal direction of the developing cartridges 222 extends diagonally forward (toward the pulling direction of the frame 221) with respect to a vertical axis. The installation/removal direction of the developing cartridges 222 in this example structure also is substantially parallel to at least a portion of the optical path of a laser beam L to be emitted from the scanner portion 218 (the term "substantially in parallel," as used in this context, includes parallel). Of course, if desired, any structure in addition to and/or in place of the roller shaft 226A may be guided via guide grooves of the types described above without departing from this invention, including any structures formed on and/or included as part of the cartridge 222.

The guide grooves 257 may be inclined at any desired angle with respect to a line connecting or plane containing the photosensitive drum shafts 230B without departing from this invention, such as at an inclined angle (e.g., greater than 0° and less than 90°). In some examples of this invention, the angle formed by the guide groove 257 with respect to a line connecting or plane containing the drum shafts 230B will be in the range of 45° to 90°, or even in the range of 65° to 90°. In the illustrated example structure of FIG. 17, this angle is about 80°.

The frame 221 further may be provided with an engaging device (not shown), e.g., in order to maintain the developing cartridges 222 at an appropriate and/or predetermined position in the cartridge mounting portions 254. For example, when the developing cartridge 222 is installed in the cartridge mounting portion 254 and reaches the appropriate mounting position, an engaging device may be engaged with the developing cartridge 222 (e.g., removably engaged, engaged by spring action or other elastic member, etc.) to hold the developing cartridge 222 in place. When a user desires to remove the developing cartridge 222 from the mounting position, the engaging device then may be disengaged from the developing cartridge 222.

Figure 20:
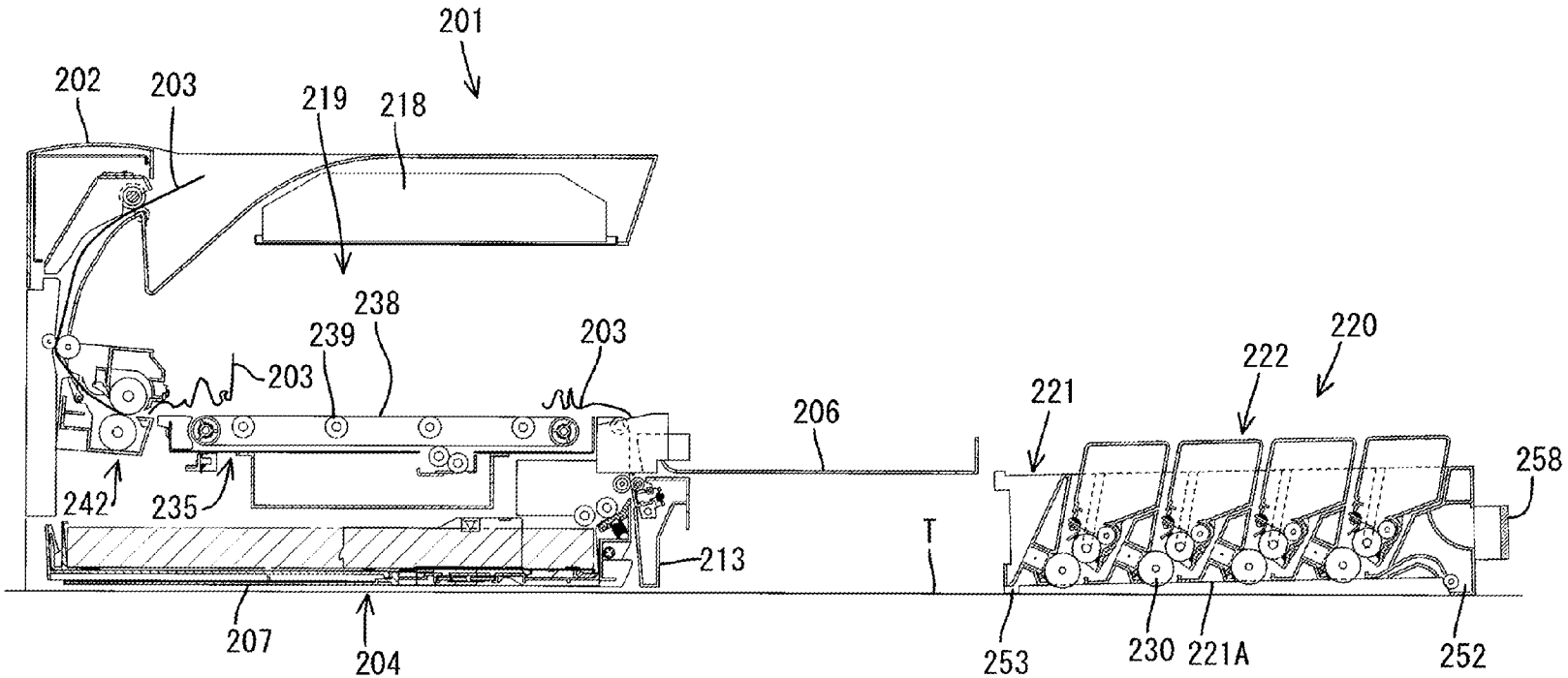
FIG. 20 is a sectional side view of the example laser printer of FIG. 17 in which the image forming unit is separated from the main casing of the laser printer.

The frame 221 of this example image forming unit structure 220 is formed with an overhang portion 252, e.g., along an entire lower front end of the front wall 249. The overhang portion 252 juts out downward from the bottom surface 221A of the frame 221. One of the register rollers (e.g., the following roller 212B) of the pair of register rollers 212A and 212B may be held by a rear surface of the overhang portion 252. The overhang portion 252 in this example structure also is integrally provided with a pair of guides 214A and 214B at its lower portion. The clearance between the pair of guides 214A and 214B provides a substantially arc-shaped sheet supply path 214 that is upwardly curved. A sheet 203 conveyed by the pair of register rollers 212A and 212B in this example structure passes through the sheet supply path 214 while being guided by the pair of guides 214A and 214B, and thus is supplied onto the transfer belt 238. A pair of rear foot portions 253 is provided at a rear lower end of the right and left sidewalls 221B of the frame 221 so as to downwardly protrude from the bottom surface 221A of the frame 221. When the image forming unit 220 is placed on a tabletop or other surface (such as a flat installation plane T or other resting surface as shown in FIG. 20), the rear foot portions 253 and the overhang portion 252 contact the surface, so that the bottom surface 221A of the frame 221 is kept at an elevated position separated from and above the resting surface. Thus, the photosensitive drums 230 are maintained at an elevated level where the photosensitive drums 230 do not contact and/or interfere with the resting surface.

A rail-like guiding device (not shown) may be provided between the image forming unit 220 and the main casing 202 in at least some example printer structures 201 according to the invention. The image forming unit 220 is capable of sliding in the front-rear directions along the guiding device (the rail-like guiding device may be conventional structures, for example, of the type so as to allow the image forming unit 220 to be mounted and move akin to the manner in which desk drawers and the like are mounted and moved). Furthermore, if desired, a retaining protrusion 255 may be provided at each sidewall 221B of the frame 221 so as to protrude upward from an upper rear end of each sidewall 221B. A corresponding fall preventing portion 256 may be provided, for example, at the inner wall of the unit accommodating portion 219 in the main casing 202 so as to protrude downward from each side of the front end of the inner wall. The fall preventing portions 256 are engageable with the retaining protrusions 255 of the frame 221 of the image forming unit 220. When the image forming unit 220 is pulled from an attached position (see FIG. 17) to a pull-stop position (see FIG. 18), the retaining protrusions 255 engage with the rear surfaces of the fall preventing portions 256 so that the image forming unit 220 is prevented from falling from the main casing 202. At the pull-stop position, the frame 221 in this example structure is downwardly tilted by its own weight such that its front end side is positioned at a level that is slightly lower than the rear end side. In this position, the retaining protrusions 255 and the fall preventing portions 256 are maintained in the engaged state. In addition, when the image forming unit 220 is located at the pull-stop position, the upper portion of the frame 221 is open in the removal direction of the developing cartridges 222 so that the developing cartridges 222 can be easily attached to and removed from the frame 221. The frame 221 may be provided with a grip portion 258, e.g., at its front wall 249, that protrudes toward the front. The grip portion 258 can be held by the user during pulling, during installation, and during removal of the image forming unit 220 from the printer 201. When the image forming unit 220 of this example structure 201 is located at the pull-stop position, the front end portion (e.g., including the grip portion 258 and/or the overhang portion 252) of the frame 221 protrudes toward the front more than the front end (e.g., the top end) of the opened front cover 206.

To pull the image forming unit 220 from the main casing 202 from the state shown in FIG. 17 (from the attached position), first, the user opens the front cover 206 of the casing 202, holds the grip portion 258 of the image forming unit 220, and pulls the image forming unit 220 toward the front. When the image forming unit 220 reaches the pull-stop position, as shown in FIG. 18, the retaining protrusions 255 contact and engage with the fall preventing portions 256 so that the image forming unit 220 stops at the pull-stop position. In this manner, the image forming unit 220 is prevented from falling from the main casing 202. When the image forming unit 220 is pulled to the pull-stop position, the developing cartridges 222 can be replaced with new ones (e.g., without completely detaching the image forming unit 220 from the casing 202). The developing cartridges 222 can be removed or detached from the frame 221 by pulling the developing cartridges 222 diagonally forward and upward with respect to the frame 221, and they can be attached to the frame 221 by pushing the developing cartridges 222 diagonally downward in the direction reverse to the cartridge removal direction. Therefore, operability can be improved when replacing the developing cartridges 222 as compared with a case where the developing cartridges 222 are attached and detached with respect to the frame 221 in a vertical direction. In addition, as described above, the frame 221 is provided with the sheet supply path 214. With this structure, in the case where a paper jam occurs while the sheet 203 is passing through the sheet supply path 214, the jammed sheet 203 can be easily removed therefrom because the jammed sheet 203 is moved forward together with the frame 221 when the frame 221 is pulled toward the front. In addition, when the image forming unit 220 is located at the pull-stop position, the front part of the sheet supply path 214 protrudes more than the front end (e.g., the top end) of the opened front cover 206. Therefore, a sheet 203 jammed in the sheet supply path 214 can be easily removed therefrom.

To separate and detach the image forming unit 220 from the main casing 202, first, the user slightly lifts the front end of the frame 221, e.g., while holding the grip portion 258, to tilt the frame 221 upward (e.g., a state shown by a double-dot and dashed line FIG. 18). In this position, the retaining protrusions 255 are diagonally downwardly moved toward the rear and thus are disengaged and separated from the fall preventing portions 256. By moving the frame 221 toward the front while the frame 221 is maintained in this inclined posture, the image forming unit 220 can be separated from the main casing 202 (e.g., akin to the manner in which drawers may be removed from a desk, cabinet, or other piece of furniture). When the image forming unit 220 is located at the pull-stop position, the grip portion 258 protrudes toward the front more than the front end (e.g., the top end) of the opened front cover 206. In this arrangement, the user can easily hold the grip portion 258 and remove the image forming unit 220 from the main casing 202.

Figure 19:
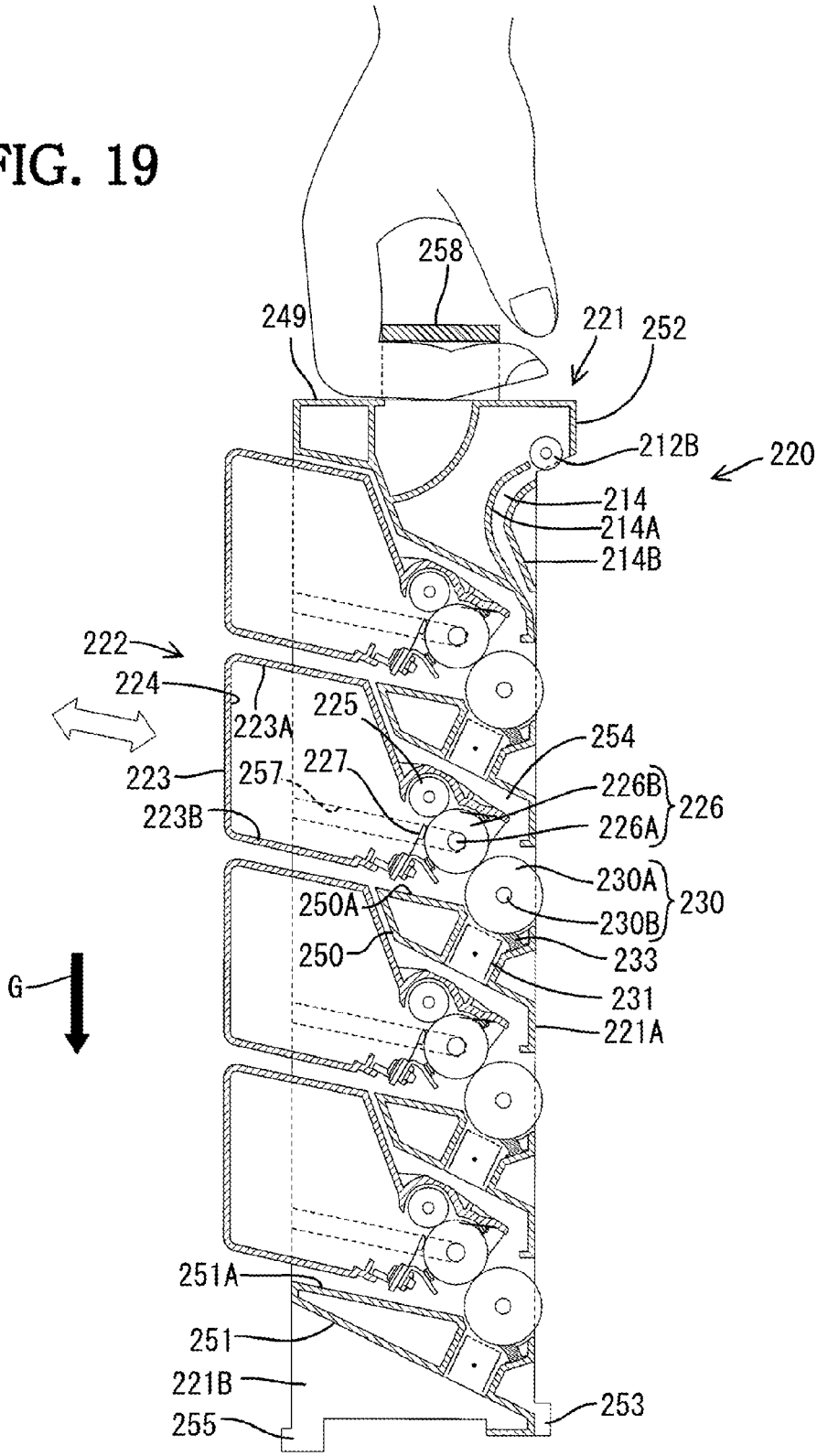
FIG. 19 is a sectional side view of an example image forming unit that is being carried outside of the main casing of the laser printer structure.

The image forming unit 220 separated from the main casing 202 as described above can be lifted while it is longitudinally oriented in a manner in which the end where the grip portion 258 is provided (e.g., the front wall 249 of the frame 221 in this example structure 220) faces up and the opposite end (the rear end of the frame 221 in the pulling direction) faces down, as shown in FIG. 19. In FIG. 19, an arrow indicated by "G" shows a downward direction. As described above, the grip portion 258 is used both when the image forming unit 220 is pulled and when it is lifted, so that a series of operations from the pulling to the lifting of the image forming unit 220 can be smoothly performed without the user having to change the holding position from one position to another. When the image forming unit 220 is lifted as shown in FIG. 19, the removal direction of the developing cartridges 222 is inclined diagonally upward. Therefore, even if some shock or other impact is made on the image forming unit 220, the developing cartridges 222 generally will not accidentally fall from the frame 211.

As described above, the image forming unit 220 can be carried to different places, including places distance from the main casing 202 of the laser printer 201. When the image forming unit 220 is placed on a surface with its bottom surface 221A facing downward, such as a resting surface, an installation plane T, a tabletop, etc., the rear foot portions 253 and the overhang portion 252 will contact the surface and the photosensitive drums 230 will be held at elevated positions separated from the resting surface as shown in FIG. 20. With this structure and arrangement, interference between the photosensitive drums 230 and the resting surface can be avoided so that repairs, part replacement, paper jam clearance, and the like can be performed without concern for damage to the photosensitive drums 230 due to contact or interference with other surfaces. Moreover, when the image forming unit 220 is separated from the main casing 202, the front of the main casing 202 is opened. Therefore, a jammed sheet 203 in the main casing 202 (see FIG. 20), as well as repairs, maintenance, and part replacement in the main casing 202, can be performed easily. As one more specific example, in this illustrated example structure 201, when the image forming unit 220 is separated from the main casing 202, the image forming unit 220 including the photosensitive drums 230 is separated from the transfer belt 238 that transfers the sheets 203 so that clearing a paper jam and/or replacement of the transfer belt 238 can be easily performed. If desired, when the photosensitive drums 230 of the image forming unit 220 are replaced with new ones, the entire frame 221 can be replaced with a new one. Alternatively, if desired, the individual drums 230 can be independently replaced and/or individual cartridges 222 can be independently replaced without replacing the entire frame 221.

In this illustrated example structure, at least some portions of the optical paths of the laser beams L emitted from the scanner portion 218 to the respective photosensitive drums 230 extend substantially in parallel with the installation/removal direction of the developing cartridges 222 (the term "substantially in parallel," as used in this context, includes parallel). In such structures, the developing cartridges 222 need to have a shape that does not cut off or interfere with the laser beams L. If the optical paths of the laser beams L extend in a direction intersecting the installation/removal direction of the developing cartridges 222, developing cartridges 222 having a large capacity generally cannot be provided. In the illustrated example structure 201, however, the final portions of the optical paths of the laser beams L (or at least the portions of the optical paths that extend along the developing cartridges 222) extend substantially in parallel with the installation/removal direction of the developing cartridges 222 so that developing cartridges 222 having a high capacity can be provided (the term "substantially in parallel," as used in this context, includes parallel).

Also, in this illustrated example structure 201, the pulling direction of the image forming unit 220 is the same as the pulling direction of the sheet supply tray 207, so that the laser printer 201 can be easily handled (e.g., can be easily moved without the tray 207 and/or image forming unit 220 falling outward, takes up less surrounding space, etc.).

Also, in the main casing 202 of the laser printer 201, the sheet supply tray 207, the transfer belt 238, the image forming unit 220, and the sheet discharge tray 247 are arranged from bottom to top in this order, so that the laser printer 201 may be made compact in size.

Figure 21:
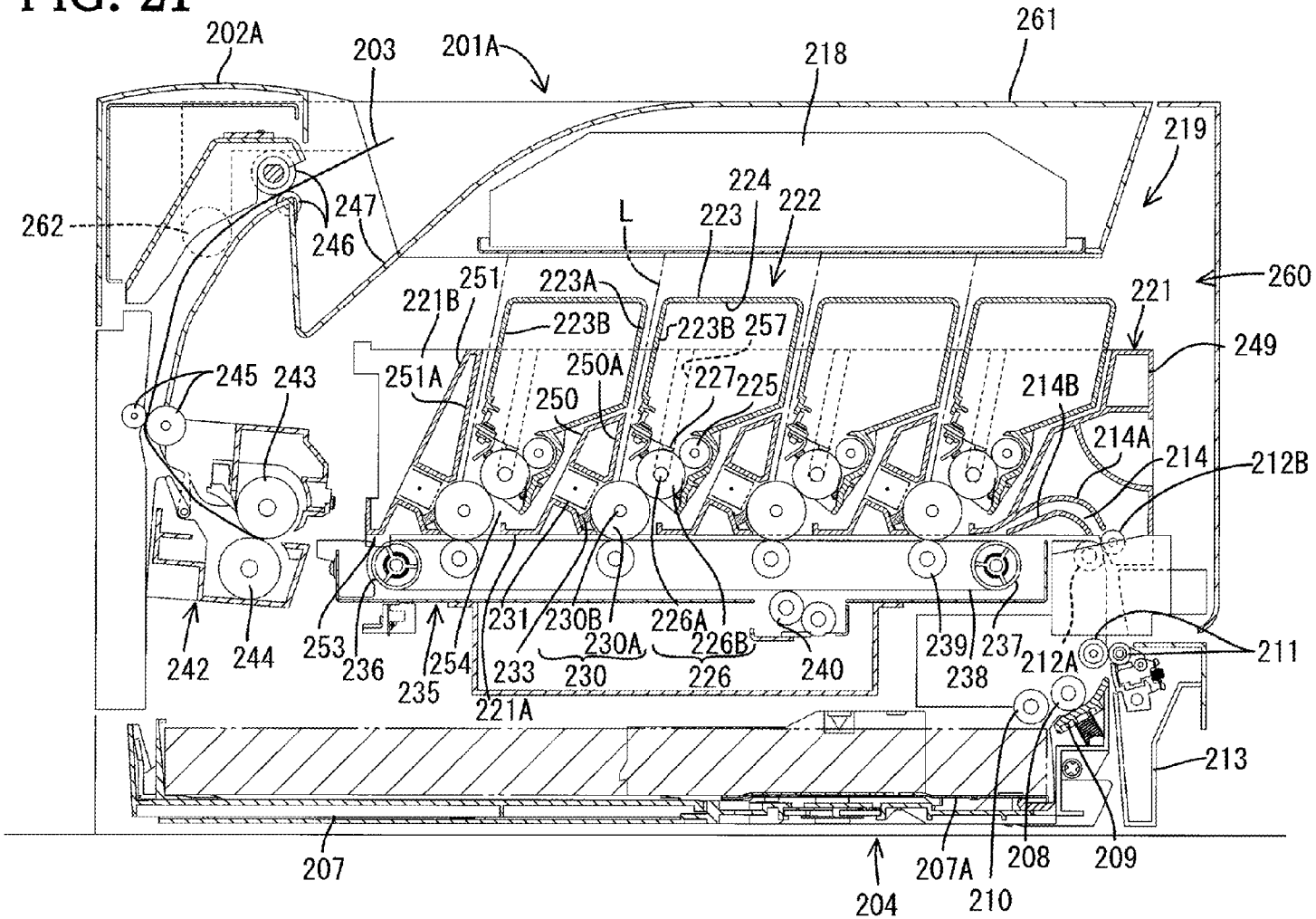
FIG. 21 is a sectional side view showing a schematic structure of an example laser printer according to another example of this invention.
Figure 22:
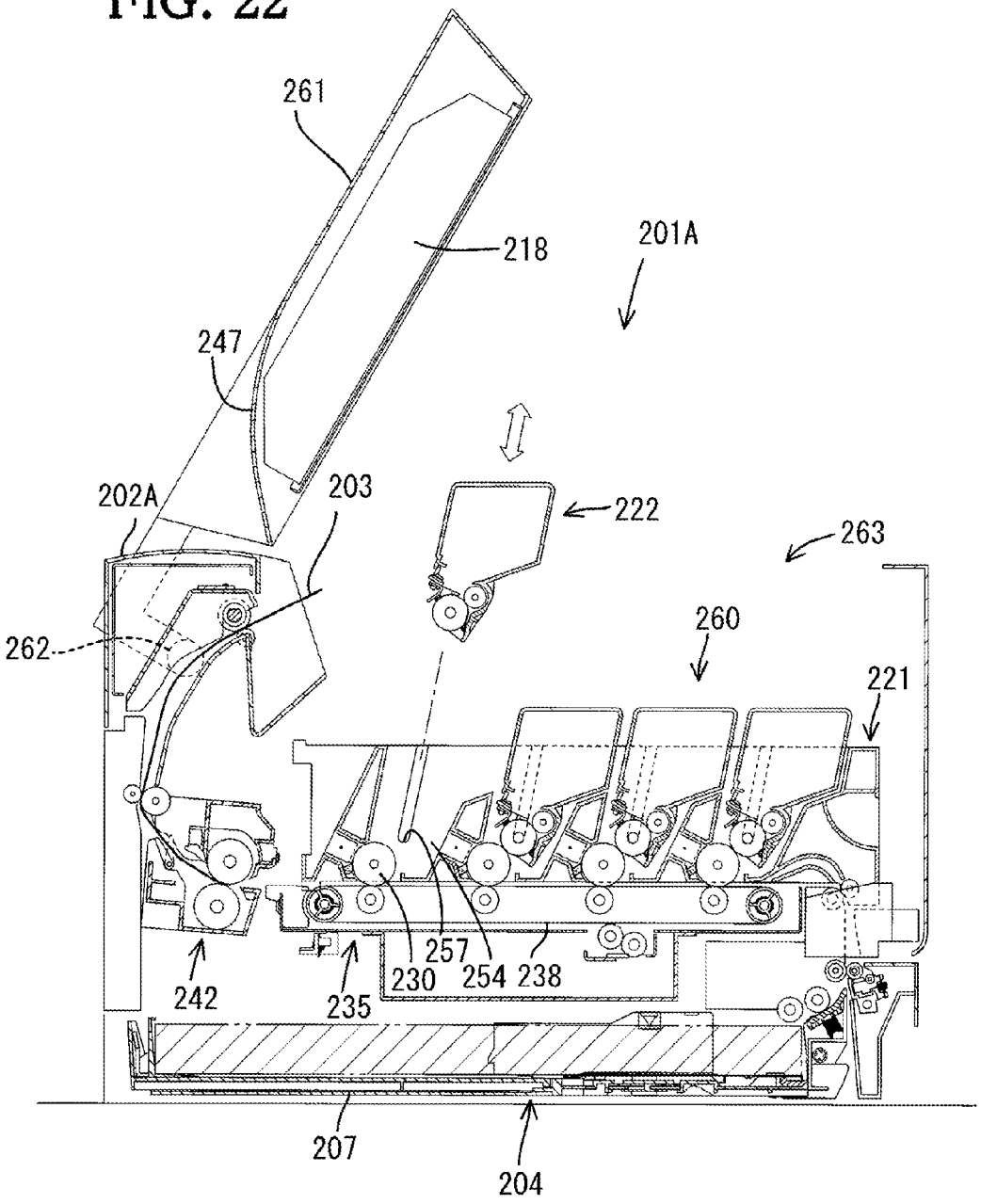
FIG. 22 is a sectional side view of the laser printer of FIG. 21 showing an upper cover of the example printer structure in an opened position.

Referring to FIGS. 21 and 22, another example image forming device structure 201A according to at least some example aspects of this invention will be described. In the following description, the right and left of FIG. 21 will be referred to as the front and the back or rear of a laser printer 201A, respectively, and the far side and the near side in FIG. 21 will be referred to as the right and the left of the laser printer 201A, respectively. The same parts as those included in the example structure of FIGS. 17-20 are designated with similar reference numerals, and explanations for those similar parts will be omitted.

The laser printer 201A of this illustrated example includes an image forming unit 260, which is provided in a main casing 202A but cannot be pulled from the main casing 202A. In this image forming unit 260, an installation/removal direction of the individual developing cartridges 222 is inclined toward the front of the printer 201A with respect to a vertical axis and is substantially parallel to at least some portions of the optical paths of laser beams L to be emitted from the scanner portion 218 (the term "substantially in parallel," as used in this context, includes parallel). The main casing 202A is provided with a top cover 261. The top cover 261 in this example printer structure 201A covers an upper portion of the image forming unit 260 and is capable of opening and closing with respect to the main casing 202A as shown in FIG. 22. The top cover 261 also is capable of pivoting between a covering position (see FIG. 21) and an uncovering position (see FIG. 22) about an attachment shaft 262, which is provided in the rear of the main casing 202A so as to extend in the right-left direction. At the covering position, as shown in FIG. 21, the top cover 261 covers the upper portion of the image forming unit 260. At the uncovering position, as shown in FIG. 22, the top cover 261 is inclined such that its front end is lifted. The scanner portion 218 is held along with and/or inside the top cover 261 and is moved along with the top cover 261. By placing the top cover 261 at the uncovering position, the upper portion of the image forming unit 260 is exposed and an opening 263 (FIG. 22) is provided. The developing cartridges 222 can be attached to and detached from the frame 221 of the image forming unit 260 through the opening 263.

In this illustrated example structure 201A, the installation/removal direction of the developing cartridges 222 is inclined with respect to a vertical direction, so that the developing cartridges 222 placed in the main casing 202A can be easily replaced with new ones. In particular, the installation/removal direction of the developing cartridges 222 is inclined toward the front so that the top cover 261, when located at the uncovering position, does not interfere with cartridge 222 removal and/or replacement operations in the main casing 202A. Thus, the replacement of the developing cartridges 222 can be further easily performed.

Figure 23:
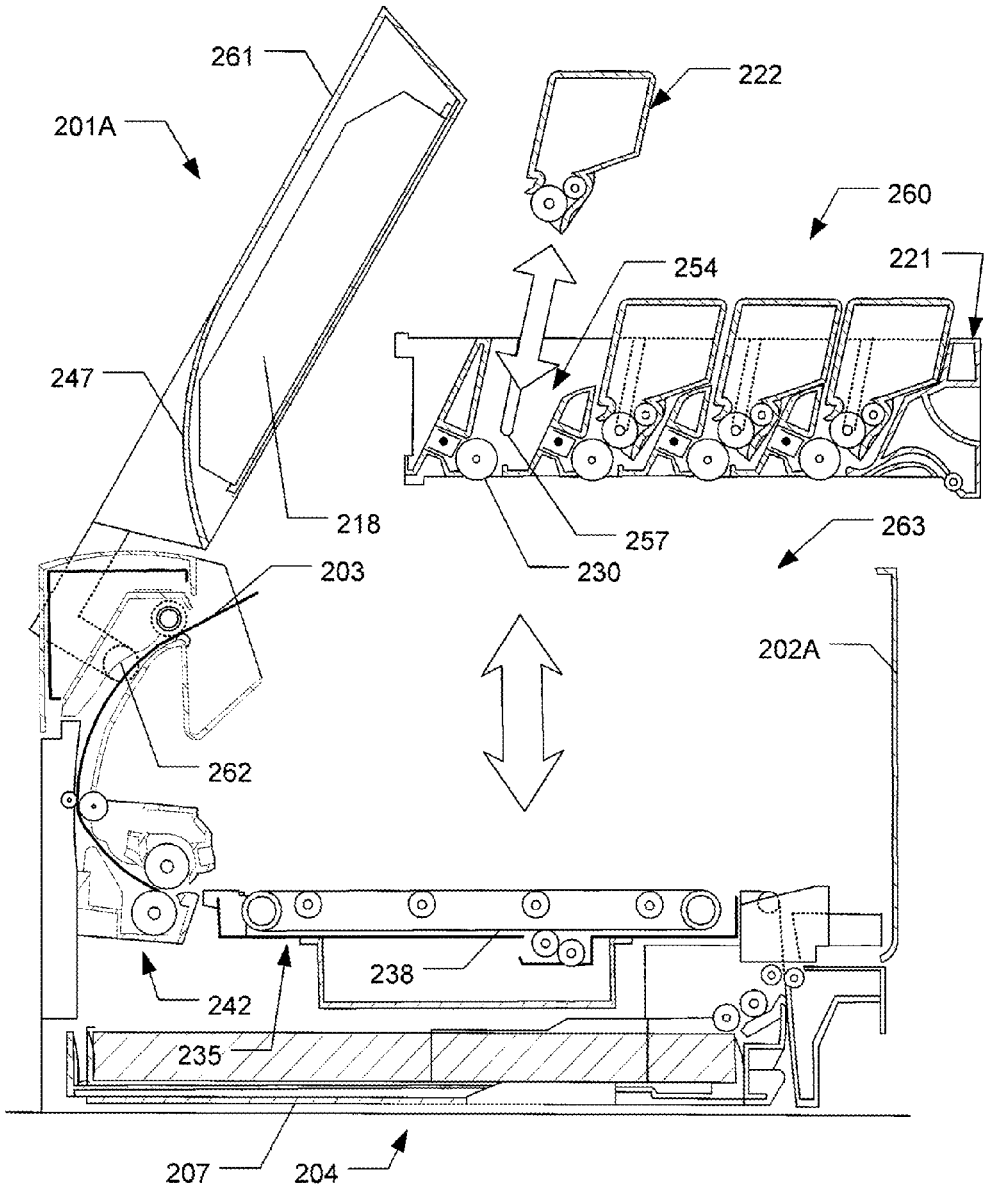
FIG. 23 is a sectional side view of an example laser printer structure showing an image forming unit vertically removable through a top opening.

Alternatively, if desired, the cover 261 may be opened and/or other structures associated with the casing 202A and/or the image forming unit 260 may be movable and/or located such that the entire image forming unit 260 can be removed from the casing 202A in the vertical direction, e.g., through the top opening 263, as generally shown in FIG. 23. If desired, the transfer belt 238 will remain in the casing 202A when the image forming unit 260 of this example structure is removed. Any desired structures for placing the image forming unit 260 in the main casing and holding it in place may be used without departing from this invention.

In the above examples, descriptions have been made using direct-tandem-type color laser printers as example image forming apparatus structures (i.e., printers in which an image is directly transferred onto a recording medium). Aspects of the present invention, however, also may be used with other image forming apparatus arrangements, such as facsimile machines, copiers, scanners, and the like. Additionally, aspects of the invention also may be practiced with other types of printers or image forming apparatuses, such as intermediate-transfer-type color laser printers or the like, in which images are transferred onto recording media via an intermediate member, such as an intermediate transfer belt or an intermediate transfer drum. For recording media onto which an image may be recorded, various media may be used without departing from the invention, such as paper, overhead transparencies, cloth, plastics, etc. The grip portion(s) of image forming apparatus structures according to the invention also may be provided in a wide variety of potential structures and/or in a wide variety of potential positions, including structures and/or positions different from those specifically identified above and in the attached drawings.

Also, in the above-described examples, the image forming unit generally is described as pulled out of the image forming apparatus casing in a generally horizontal or vertical direction with respect to the main casing. Alternatively, if desired, the image forming unit may be pulled in other directions without departing from the invention, such as diagonally upward with respect to the main casing. Exposure of the photosensitive member(s) (e.g., drums, belts, etc.) also may be performed with a wide variety of different scanning and/or light sources without departing from the invention, including conventional scanning systems known and used in the art.

While the invention has been described in detail with reference to the specific example structures thereof, those skilled in the art will recognize that various changes, arrangements, and modifications may be used and applied to the disclosed structures without departing from the spirit and scope of the invention as defined in the attached claims.

What is claimed is:

1. An image forming unit for use with an image forming apparatus, the image forming apparatus being configured to form an image on a sheet, comprising:
- a frame including:
  - a first side plate;
  - a second side plate;
  - a front beam connecting a front end of the first side plate and a front end of the second side plate; and
  - a rear beam connecting a rear end of the first side plate and a rear end of the second side plate;
- a handle including:
  - a first arm,
  - a second arm, and
  - a grip portion connecting a first end of the first arm and a second end of the second arm; and
- a cartridge detachably attachable to the frame,
- wherein the handle is pivotably coupled to the frame, and
- wherein the handle is pivotable between
  - a pulling position where the grip portion is located between an upper end of the front beam and a lower end of the front beam, and
  - a lifting position where the grip portion is located upside of the upper end of the front beam.

2. The image forming unit according to the claim 1, further comprising:
- a first shaft pivotably connecting the first arm and the first side plate; and
- a second shaft pivotably connecting the second arm and the second side plate.

3. The image forming unit according to the claim 2, wherein the first arm further comprises a retaining protrusion, and
- wherein when the handle is in the pulling position, the retaining protrusion is able to engage with a fall preventing portion disposed on the image forming apparatus, and
- wherein when the handle is in the lifted position, the retaining protrusion is released from the fall preventing portion disposed on the image forming apparatus.

4. The image forming unit according to the claim 1, further comprising:
- a photosensitive member rotatably supported by the frame,
- wherein the cartridge further comprises:
  - a developing device configured to develop an image on the photosensitive member; and
- wherein the frame further comprises:
  - a guide member configured to guide the cartridge to move along a first direction, each cartridge being configured to be attached to and detached from the frame in the first direction.

5. The image forming unit according to the claim 1, further comprising:
- a first register roller disposed on the frame,
- wherein the image forming apparatus comprises a second register roller, and
- wherein when the image forming unit is attached to the image forming apparatus, the first register roller on the image forming unit and the second register roller on the image forming apparatus face each other.

6. The image forming unit according to the claim 5, further comprising:
- a photosensitive member rotatably supported by the frame; and
- a sheet guide configured to guide the sheet and be disposed between the first register roller and the photosensitive member.

7. An image forming apparatus comprising:
- a casing comprising an engage member; and
- an image forming unit movably coupled to the casing, comprising:
  - a frame including:
    - an arm;
    - a handle disposed on the arm;
    - a retaining protrusion disposed on the arm;
    - an urging member configured to urge the arm from a first position to a second position; and
  - a cartridge detachably attachable to the frame,
- wherein the arm is movable between the first position where the retaining protrusion separates from the engage member and the second position where the retaining protrusion engages with the engage member.

8. The image forming unit according to the claim 7, further comprising:

a photosensitive member rotatably supported by the frame, wherein the cartridge further comprises a developing device configured to develop an image on the photosensitive member, and wherein the frame further comprises a guide member configured to guide the cartridge to move along a first direction, each cartridge being configured to be attached to and detached from the frame in the first direction.

9. The image forming unit according to the claim 7, further comprising:

a first register roller disposed on the frame, wherein the image forming apparatus comprises a second register roller, and wherein when the image forming unit is attached to the image forming apparatus, the first register roller on the image forming unit and the second register roller on the image forming apparatus face each other.

10. The image forming unit according to the claim 9, further comprising:

a photosensitive member rotatably supported by the frame; and a sheet guide configured to guide the sheet and be disposed between the first register roller and the photosensitive member.

11. An image forming unit for use with an image forming apparatus, the image forming apparatus being configured to form an image on a sheet, comprising:

a frame including:

a first side plate;

a second side plate;

a front beam connecting a front end of the first side plate and a front end of the second side plate; and a rear beam connecting a rear end of the first side plate and a rear end of the second side plate;

a handle including:

a first arm, a second arm, and a grip portion connecting a first end of the first arm and a second end of the second arm;

a first shaft pivotably connecting the first arm and the first side plate;

a second shaft pivotably connecting the second arm and the second side plate; and a cartridge detachably attachable to the frame, wherein the handle is pivotably coupled to the frame.

12. The image forming unit according to the claim 11, further comprising:

a photosensitive member rotatably supported by the frame, wherein the cartridge further comprises:

a developing device configured to develop an image on the photosensitive member; and wherein the frame further comprises:

a guide member configured to guide the cartridge to move along a first direction, each cartridge being configured to be attached to and detached from the frame in the first direction.

13. The image forming unit according to the claim 11, further comprising:

a first register roller disposed on the frame, wherein the image forming apparatus comprises a second register roller, and wherein when the image forming unit is attached to the image forming apparatus, the first register roller on the image forming unit and the second register roller on the image forming apparatus face each other.

14. The image forming unit according to the claim 13, further comprising:

a photosensitive member rotatably supported by the frame; and a sheet guide configured to guide the sheet and be disposed between the first register roller and the photosensitive member.

15. An image forming apparatus comprising:

a casing comprising an engage member; and an image forming unit movably coupled to the casing, comprising:

a frame including:

a retaining protrusion movable between a separate position where the retaining protrusion separates from the engage member and an engage position where the retaining protrusion engages with the engage member; and an urging member configured to urge the retaining protrusion from the separate position to the engage position; and a cartridge detachably attachable to the frame.

16. The image forming apparatus according to the claim 15, further comprising:

a handle movable between a first position and a second position, wherein the retaining protrusion is coupled to the handle, wherein in a case where the handle is in the first position, the retaining protrusion is in the separate position, and wherein in a case where the handle is in the second position, the retaining protrusion is in the engage position.

* * * * *